US010267563B2

(12) United States Patent
Kuta et al.

(10) Patent No.: US 10,267,563 B2
(45) Date of Patent: Apr. 23, 2019

(54) SYSTEM, METHOD, AND ADJUSTABLE LAMP HEAD ASSEMBLY, FOR ULTRA-FAST UV CURING

(71) Applicant: Excelitas Canada, Inc., Mississauga (CA)

(72) Inventors: John Joseph Kuta, Oakville (CA); Guomao Yang, Nepean (CA)

(73) Assignee: Excelitas Canada, Inc., Vaudreuil-Dorion (CA)

( * ) Notice: Subject to any disclaimer, the term of this patent is extended or adjusted under 35 U.S.C. 154(b) by 0 days.

(21) Appl. No.: 15/676,254

(22) Filed: Aug. 14, 2017

(65) Prior Publication Data

US 2017/0343281 A1 Nov. 30, 2017

Related U.S. Application Data

(63) Continuation of application No. 12/582,492, filed on Oct. 20, 2009.

(60) Provisional application No. 61/139,203, filed on Dec. 19, 2008.

(51) Int. Cl.

| | |
|---|---|
| ***F26B 3/34*** | (2006.01) |
| ***F26B 3/28*** | (2006.01) |
| *B41J 11/00* | (2006.01) |

(52) U.S. Cl.

CPC ..... *F26B 3/28* (2013.01); *B41J 11/002* (2013.01)

(58) Field of Classification Search

CPC ..... B41J 11/002

See application file for complete search history.

(56) References Cited

U.S. PATENT DOCUMENTS

| | | | |
|---|---|---|---|
| 2,002,033 | A | 5/1935 | Kopsa |
| 3,983,039 | A | 9/1976 | Eastland |
| 5,521,392 | A | 5/1996 | Kennedy et al. |
| 5,840,239 | A | 11/1998 | Partanan et al. |
| 5,945,680 | A | 8/1999 | Jensen |

(Continued)

FOREIGN PATENT DOCUMENTS

| | | |
|---|---|---|
| CH | 690031 | 3/2002 |
| EP | 1293740 | 3/2003 |
| WO | WO199112897 | 9/1991 |

OTHER PUBLICATIONS

Dr. S. Jonsson and Catharina Hasselgren, "Secrets of the Dark", Fusion UV Systems; date unknown.

*Primary Examiner* — Jason Lau

(74) *Attorney, Agent, or Firm* — Peter A. Nieves; Sheehan Phinney Bass & Green PA

(57) ABSTRACT

A UV curing system and method for providing an adjustable beam profile are disclosed for UV curing for ultra high speed industrial applications, such inkjet printing with improved print quality and efficiency. Also provided is a lamp head assembly for a UV source for such a system, which provides an adjustable beam profile for optimizing UV curing. The lamp head assembly comprises one or more light sources and reflectors or other optical elements, which may be relatively movable and adjustable, to adjust the beam profile to processing conditions and requirements for consistent curing efficiency and print quality at different print speeds. Specific features of such a lamp head assembly may permit adjustment of the spectral, spatial and temporal distribution of light for improved or optimized curing efficiency in ultra-fast UV curing applications.

16 Claims, 14 Drawing Sheets

(56) References Cited

U.S. PATENT DOCUMENTS

| | | | | |
|---|---|---|---|---|
| 6,206,548 | B1 | 3/2001 | Lassovsky | |
| 6,617,596 | B1 | 9/2003 | Korenev | |
| 6,621,087 | B1 | 9/2003 | Bisges et al. | |
| 6,649,921 | B1 | 11/2003 | Cekic et al. | |
| 6,683,421 | B1 | 1/2004 | Kennedy et al. | |
| 6,732,451 | B2 | 5/2004 | Conwell et al. | |
| 6,797,971 | B2 | 9/2004 | Cekic et al. | |
| 6,942,367 | B2 | 9/2005 | Tausch | |
| 7,002,170 | B2 | 2/2006 | Schweitzer | |
| 7,047,662 | B2 | 5/2006 | Ihme et al. | |
| 7,128,429 | B2 | 10/2006 | Tausch | |
| 7,137,695 | B2 | 11/2006 | Yokoyama | |
| 7,175,712 | B2 | 2/2007 | Siegel | |
| 7,211,299 | B2 | 5/2007 | Siegel | |
| 7,701,552 | B2 | 4/2010 | Lee et al. | |
| 2004/0165391 | A1 | 8/2004 | Blacker, Jr. et al. | |
| 2005/0092942 | A1 | 5/2005 | Schmitkons et al. | |
| 2006/0292311 | A1 | 12/2006 | Kilburn et al. | |
| 2007/0058021 | A1 | 3/2007 | Kusunoki | |
| 2007/0115335 | A1* | 5/2007 | Vosahlo ..... | B41J 11/002 347/102 |
| 2007/0273957 | A1 | 11/2007 | Zalevsky et al. | |

* cited by examiner

SYSTEM, METHOD, AND ADJUSTABLE LAMP HEAD ASSEMBLY, FOR ULTRA-FAST UV CURING

CROSS REFERENCE TO RELATED APPLICATIONS

This application is a continuation of U.S. application Ser. No. 12/582,492, filed Oct. 20, 2009 and entitled System, Method, and Adjustable Lamp Head Assembly, for Ultra-Fast UV Curing, which claims priority to U.S. Provisional patent application No. 61/139,203, filed Dec. 19, 2008, the entire contents of each of these applications are hereby incorporated by reference in their entireties.

TECHNICAL FIELD

The present invention relates to high speed and ultra-fast UV curing and, in particular, to a system, method, and adjustable (UV) lamp head assembly for improved curing efficiency and print quality for high speed print applications.

BACKGROUND

There is an increasing demand for large-scale industrial curing of UV curable coatings and inks requiring high speed or ultra fast processing for improved productivity. However, at higher print speeds, problems with inconsistency in print quality and poor curing efficiency may be encountered.

In UV curing of photo-curable inks and other coating materials, UV energy is absorbed by a sensitizer and initiates a curing process, e.g. causing polymerization of monomers, which dries and hardens the ink or coating material. The rate of the curing process usually depends on many factors, such as, the type of chemical compound, the UV light wavelength and intensity, the thickness of the coating, surface conditions, dissolved oxygen levels, and other process parameters or ambient conditions.

Several competing processes contribute to the overall reaction during photo-polymerization of UV curable inks. The general process starts from light being absorbed by photo-initiators to create free radicals, which are required to initialize polymerization of monomers in the ink formulation, which causes an increase of viscosity. However, because of the high reactivity of oxygen, initially free radicals are consumed by oxygen dissolved in the ink, and/or diffused oxygen from outside, i.e. in the ambient air. The polymerization reaction dominates only after dissolved oxygen concentrations have been consumed so as to fall to a sufficiently low level, and after the system viscosity is above a certain level such that the oxygen diffusion rate is slow enough.

For high speed and ultra-fast printing, conventional approaches to increase the rate of curing, and to increase efficiency to overcome oxygen related problems, have been focused on providing higher intensity UV illumination to enable faster processing, i.e. simply increasing power input. Unfortunately, increasing power input does not necessarily solve the problems of poor or inconsistent print quality. At the same time, since UV curing is an energy intensive process, and with the increased global concern regarding energy usage and the environment, there is also a need to design more energy efficient systems, and reduce power demands, particularly for large-scale industrial applications.

In the area of UV lamp design, there have been two main approaches to increase the efficiency of UV curing systems. The first one has focused on improving the ballast efficiency, and the other one is to minimize light loss by modifying reflector design. Using both methods, UV curing systems using UV lamps manufactured, for example, by IST METZ were recently reported to provide an increase in efficiency of 40%. Compared to conventional ballasts, square-wave ballast technology, such as used in UV lamps by GEW, for example, can reduce energy consumption by up to 30% for an equivalent cure. Both approaches aim at increasing the amount of UV irradiation delivered to the UV curable materials. However, current ballast efficiency is now typically higher than 95% and most reflector designs have already been optimized to direct the maximum amount of the light to the substrate. This leaves little room for further improvement in the amount of UV irradiation with unit amount of input electrical power. Therefore, there is a pressing need for other novel approaches to improving curing efficiency for high speed processing.

UV inkjet printing technology is moving forward rapidly as it displaces traditional printing methods. For increased throughput, there is always a need for improved UV system curing efficiency, for large scale and ultra high speed curing, in industrial sectors such as digital printing, packaging, and automotive applications. For a UV curing system typically used in inkjet printing applications, the FWHM of the UV beam profile is about 2-6 cm. Such a narrow beam profile only produces an illumination of about 10-30 ms for single scan in a wide format inkjet printer with a scanning speed of about 2 m/s. Manufacturing environments do not typically provide an oxygen free environment during the curing process (in view of expense), and therefore oxygen acts as a barrier to slow down the process. An illumination time of 10-30 ms is not usually long enough for free radicals to consume oxygen because of the inherent reaction rates. This results in the need for multiple exposures of the ink to achieve full cure. The specific exposure time required is a function of the ink chemistry, which varies from supplier to supplier, but as a general rule cumulative exposure times should exceed 50-100 ms. As scanning speeds increase for higher productivity, the illumination time becomes even shorter. Such limitation requires the industry to use even larger numbers of scans to achieve acceptable curing result. This does not satisfy the current and upcoming needs for higher productivity.

In one approach to increase the cure speed, U.S. Pat. No. 3,983,039 teaches a lamp unit with a single light source and an elongated reflector producing a diffuse lower intensity region for pre-cure, to seal the surface to reduce oxygen diffusion, followed by a high intensity region for the main cure. In practice, surface curing by intermediate or low level of UV radiation is found to be less effective than use of a higher level of UV radiation. As is known, oxygen has to be consumed to a certain level before polymerization can start and oxygen consumption has high efficiency unless the light intensity reaches certain threshold intensity. Below this threshold, oxygen consumption is slower than oxygen diffusion from outside so the polymerization reaction will fail to start. In many cases, a beam of this profile, providing diffuse lower intensity radiation at the leading edge of the light source actually extends the region of light below the threshold for initiating curing, and thus wastes light and results in poor print quality. Also, for many UV curing applications in digital printing, particularly wide format inkjet painting, a very large lamp width having an extended reflector such as taught in U.S. Pat. No. 3,983,039 is not suitable because of space limitations for lamp heads in existing printers.

Alternatively, in the past decades, UV light source companies have taught the use of extremely high intensity light for fast cure. For example, U.S. Pat. No. 5,945,680 describes an apparatus with a focusing of the light to a comparatively narrow light line with a high light intensity by a rod-shaped lens. For free radical induced polymerization, there is a simple relation between the overall rate of polymerization, Rp, and the light intensity, $Rp=a(I)^b$. The power factor, b is about 0.5, however it is smaller when the light intensity is extremely high. The landmark study by Dr. S. Jonsson, "Secrets of the Dark", confirmed that increasing intensity 20 times increased the maximum polymerization rate by only about 50%, which indicates that using extremely high intensity to increase polymerization rate is not a very efficient way of utilizing light. In view of the non-linear relationship between light intensity and rate of polymerization, at increasingly higher intensity, in practice, less improvement in polymerization rate and degree of conversion is possible. In addition, to achieve extremely high intensity, the beam must be focused so that the optical profile in a lateral direction of such systems is narrow, allowing for only extremely short illumination time in high speed processing. Short illumination times are problematic because there is a minimum period of exposure needed to consume residual and diffused oxygen before curing proceeds. The time period is determined by the kinetics of chemical reactions for consuming oxygen. At ultra fast process speeds, such a narrow optical profile does not provide enough illumination time required to overcome oxygen inhibition, which is required to achieve good cure result.

It is well known that all UV curing processes in air have to overcome oxygen inhibition effects to achieve a satisfactory curing quality. However, with pressing requirements for higher productivity, the relative speed between the curing light source and substrate increases. This pushes the illumination time closer to the induction time, which is required as a minimum illumination time. Traditional approaches to overcoming limited processing time for high speed print, i.e. further increasing light intensity, fail to resolve the loss of curing efficiency, because illumination with a narrowly focused higher intensity light effectively makes the illumination time even shorter.

As mentioned above, there are two sources of oxygen to be consumed: the residual oxygen in the UV curable material, i.e. in the ink, and the diffused oxygen from outside. The residual oxygen in the ink can be consumed by a high intensity UV light in a reasonable short time period. However, oxygen diffusion is a dynamic process, which will slow down when the viscosity of the bulk material increases because of the chain reaction in photo-polymerization. Such chain reaction takes a certain amount of time, which is in sub-second range, to build a network in the bulk material with viscosity high enough to compete with oxygen diffusion from outside. Traditional methods of increasing light intensity for a high speed UV curing process may consume residual oxygen in the ink, but if ultrahigh speed processing is needed, and the allowed exposure time is close or even less than the induction time, such method of increasing light intensity fails to provide satisfactory curing quality. This results in low light utilization, and a low system curing efficiency.

While it has long been recognized that the oxygen inhibition effect exists, in attempting to solve the problem by simply using more power, i.e. using extremely high intensity illumination for a short duration, the industry has failed to recognize the significance of the problem associated with the kinetics of oxygen inhibition. That is, the time scale of the kinetics of oxygen inhibition is longer than the illumination time of the substrate for high speed processing using such narrow focused optical profiles. Consequently, illumination at extremely high intensity, particularly above a certain saturation level, and for shorter illumination time, leads to low efficiency of light utilization for photo-polymerization for effective UV curing. The use of higher power and higher intensity light sources also interferes with print quality on temperature sensitive substrates such as PVC, thin films and thermally activated substrates. Print quality is reduced because the energy delivered by the curing system that is not consumed by the curing process creates heat that can deform the substrates. This can lead to warping of rigid substrates on flatbed style wide format printers, or shrinkage of flexible substrates.

Since advances in wide format printing system design are driving the speed of printing higher, and it is expected that with current equipment, the curing efficiency of light delivered to the ink will continue to fall due to ever decreasing exposure times. As the curing efficiency falls, the degree to which the ink is cured for a single pass of the light source will be reduced. This will lead to inconsistent print quality when print samples are compared between slower print systems, and higher speed systems.

In attempts to overcome these problems, the digital print industry has taken two main strategies to move to higher speed printing:

1. reducing ink deposition and using very high powered lamps, and
2. increasing the number of passes of the light source to accumulate a sufficient dose of UV.

However, reducing ink deposition limits the print quality. By increasing the number of passes, it slows the printing process down, because each pass requires time. As dark curing plays an important part in the chemical reaction, the time period between each illumination, which varies from printer to printer, may cause inconsistencies in print quality. In addition, for high coverage printing, the ink adhesive and potential surface finish will be a function of the number of passes—leading to potential print quality inconsistencies from different models of printers, or from the same printer if the print canine speed is changed.

Thus, there is a need for improved apparatus and methods to overcome these print inconsistencies by maintaining a consistent degree of cure in a single pass of the curing system.

SUMMARY OF INVENTION

The present invention therefore seeks to overcome or mitigate the above-mentioned problems, or at least provide an alternative.

To this end, the present invention seeks to improve UV curing efficiency by optimizing the optical beam profile to overcome the low curing efficiency in ultra high speed curing processes, and in particular provides a system for UV curing with an adjustable beam profile, and a method of UV curing which comprises determining optimal system setup for a beam profile according to the process requirements. Also provided is lamp head assembly with control/adjustment means for providing an adjustable beam profile. Thus, systems and methods are provided which enable adjustment of the beam profile to provide improved curing efficiency based cm process parameters, e.g. the properties of the printer, ink, and the print pattern to be produced.

According to one aspect of the present invention, there is provided a system for UV curing of photosensitive materials comprising; means for supporting a substrate comprising photosensitive materials to be cured, a lamp head comprising a lamp assembly comprising at least one (UV) light source and optical elements for generating a UV beam of a desired beam profile for irradiating an area of the photosensitive materials to be cured; means for relatively moving the substrate and the lamp head at a desired traverse speed (v) for sequentially illuminating areas of the substrate; and control means, the control means including: beam profile adjustment means for controlling lamp parameters of the lamp assembly to adjust the beam profile by controlling at least a beam width ($W_s$) and intensity I(w) of the beam, dependent on the traverse speed (v) and other process parameters.

Preferably the system comprises input means for inputting said process parameters, and control/adjustment means on the lamp head assembly for setting lamp parameters based on said process parameters. The system may also comprise input means for inputting print test results, and control/adjustment means on the lamp head assembly for setting lamp parameters based on said print test results. The beam profile control means comprises means for controlling parameters of the lamp assembly to provide a beam profile having a desired spectral, spatial and temporal distribution of light dependent on said process parameters.

Another aspect of the invention provides a lamp assembly for a UV curing system comprising: at least one (UV) light source and optical elements for generating a UV beam of a desired beam profile I(w) for irradiating an area of the photosensitive materials to be cured; a control/adjustment means for adjusting parameters of the light source and optical means to control at least a beam width (w) and an intensity profile I(w) of the beam, and input means for receiving control signals for selecting lamp parameters to control the beam profile dependent on print speed (v) and other process parameters. Thus, the lamp profile may be adjusted dependent on process parameters comprising one or more of one or more of substrate and ink parameters; print speed; environmental parameters; and print quality requirements.

Another aspect of the invention provides a method of selecting a beam profile for a lamp head assembly in a UV curing system comprising an adjustable lamp head assembly, to provide a desired beam profile for optimizing UV curing of a photosensitive material to be cured, comprising steps of: setting lamp parameters to provide a default (initial) beam profile based on print speed and process parameters; running a sample cure test; determining results of the sample cure test; comparing results with acceptable test limits; and, if results are not within acceptable limits, adjusting lamp parameters to change at least one of a lamp intensity and a beam width of the beam profile; repeating a sample cure trial and monitoring results of the sample cure test until results fall within acceptable limits.

A default (initial) lamp profile may be determined based on a calculation of the induction time and the parameters for the process comprising at least one of the UV curable material, oxygen concentration, and curing speed, the beam width being set to provide illumination of the substrate for at least the calculated induction time, based on the relative traverse speed of the lamp assembly and the illuminated area of the substrate to be cured. If test results are within acceptable limits, a constant beam width is maintained and the lamp power is reduced and to determine a minimum lamp power, at the selected beam width, for which cure test results fall within acceptable limits. If test results are not within acceptable limits for a selected lamp power, the beam width is increased, to determine a beam width at which cure test results fall within acceptable limits. Beam width is defined as the beam width $W_s$ above a predetermined saturation intensity $I_s$.

Thus, beneficially, the lamp head assembly provides for an adjustable beam profile for optimizing UV curing dependent on process speed and other process parameters. The system and method are suitable for UV curing for ultra high speed industrial applications such inkjet printing. The system therefore comprises control means for adjusting parameters of the lamp head to control the optical beam profile of the lamp, for example parameters including intensity and beam dimensions (beam width) relative to the print/scanning speed of the printer to provide the appropriate spatial distribution of light, and appropriate photon flux to provide the appropriate temporal illumination of the substrate. Other parameters relating to the substrate and ink/coating to be processed may also be used to determine or specify appropriate lamp head settings for effective curing dependent on process requirements.

In preferred embodiments, the lamp head assembly comprises one or more UV light sources and optical elements (e.g. reflectors or lenses) to shape the beam profile, some or all of which may be relatively movable and adjustable to adapt the beam profile to processing conditions and requirements for consistent curing efficiency and print quality at different print speeds. Specific features of such light sources permit variable combination in the spectral, spatial and temporal distribution of light for improved or optimized curing efficiency in ultra fast UV curing applications. Also provided is a method comprising monitoring curing parameters and adjusting the beam profile accordingly.

In preferred embodiments of the lamp head assembly, a mechanical adjustment system is provided to control the beam profile and provide a preferred optical profile as determined by the method. In particular, the optical profile preferably combines a proper light intensity and a wide enough beam width for achieving optimal curing efficiency. Advantageously, the proper intensity level is set above an empirically determined threshold and preferably around an empirically determined saturation level. Such arrangement avoids the waste of light in seeking ultra high light intensity and provides a beam width large enough to accommodate the time budget needs of oxygen consumption in ultra high speed curing.

Preferred embodiments provide for adjusting the lamp head settings, e.g. varying the relative positions of the lamps inside the lamp head and/or the positions of reflectors, so that UV curing system efficiency can be optimized according to the process needs, e.g. different curing speed requirements, optical thickness and the chemistry of UV curable materials.

Thus, embodiments of the present invention provide for the optical beam profile to be adjusted specifically for a certain process, based on process and system parameters.

The foregoing and other objects, features, aspects and advantages of the present invention will become more apparent from the following detailed description, taken in conjunction with the accompanying drawings, of preferred embodiments of the invention, which description is by way of example only.

DESCRIPTION OF PREFERRED EMBODIMENTS

Figure 1:
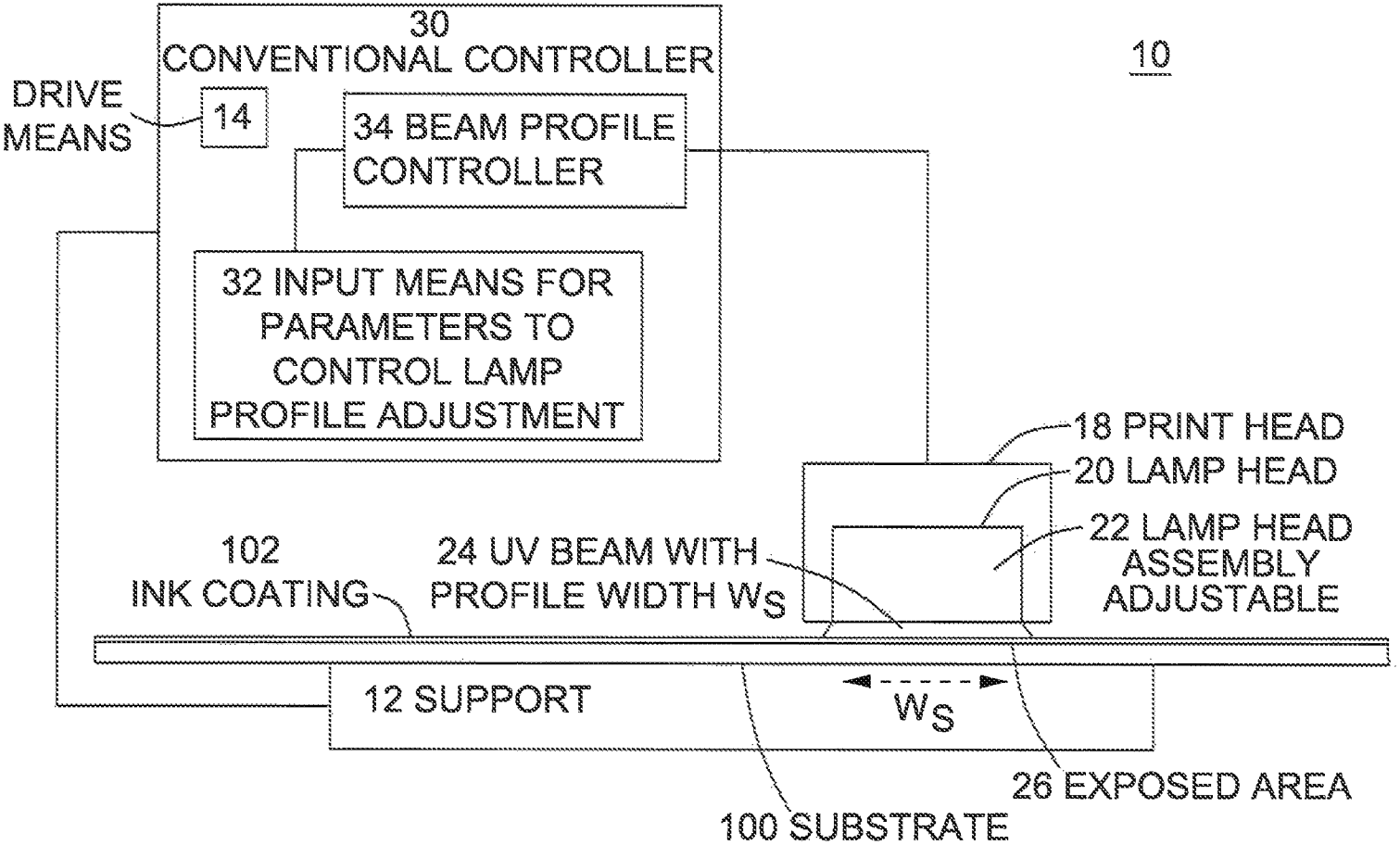
FIG. 1 shows a schematic diagram of a UV curing system according to an embodiment of the present invention.

FIG. 1 shows a simplified schematic diagram of a UV curing system 10 according to a first embodiment of the present invention. The system comprises a support 12 for carrying a substrate 100 having an ink or coating 102 to be cured, a UV curing lamp head 20, which carries an adjustable lamp head assembly 22 for generating a UV beam 24 having a desired beam profile to illuminate or irradiate an area 26 of the coating/substrate 102/100 as required. The adjustable lamp head assembly 22 will be described in more detail below, and typically comprises one or more UV light sources, and optical elements such as reflectors, for adjusting parameters of the UV illumination to provide a desired beam profile. The system comprises drive means 14, usually a linear motion system, for relatively moving the substrate 100 and the print engine comprising the print head 18 for delivering the ink to be cured, and one or more lamp head(s) 20 for UV curing. Two typical arrangements are shown in more detail in FIGS. 1A and 1B. That is, the support 12 may move the substrate under the illuminated region 26, and/or the lamp assembly may be movable to scan the print engine together with the lamp head(s) 20 for scanning the illuminated area 26 across the area of the substrate to be cured. Typically in ultra-fast printing applications the relative speed between the substrate and the printhead may be ~2 m/s, and very high speed printing may have a print throughput up to ~600 $m^2$/hr.

Referring to FIG. 1, control means, comprising control apparatus 30 provides for power and control of the relative movement of the substrate and the print head 18 and other conventional control of the apparatus, such as ink delivery, calibration, substrate loading/unloading, emergency stop et al. The control means 30 also comprises a lamp head controller 34 which controls parameters of the lamp head assembly 22, such as intensity, beam width and length, and other parameters related to the beam profile as will be described in more detail with reference to FIGS. 3 to 15. Interface/input means 32 provides for user input or input from print test and monitoring apparatus (not shown) to the controller 30, for adjusting print parameters and/or lamp head parameters to meet specific processing requirements, dependent on the substrate, ink parameters, and print speed; environmental parameters (e.g. oxygen concentration, humidity, temperature); and print quality requirements (e.g. resolution, surface finish).

Figure 1A:
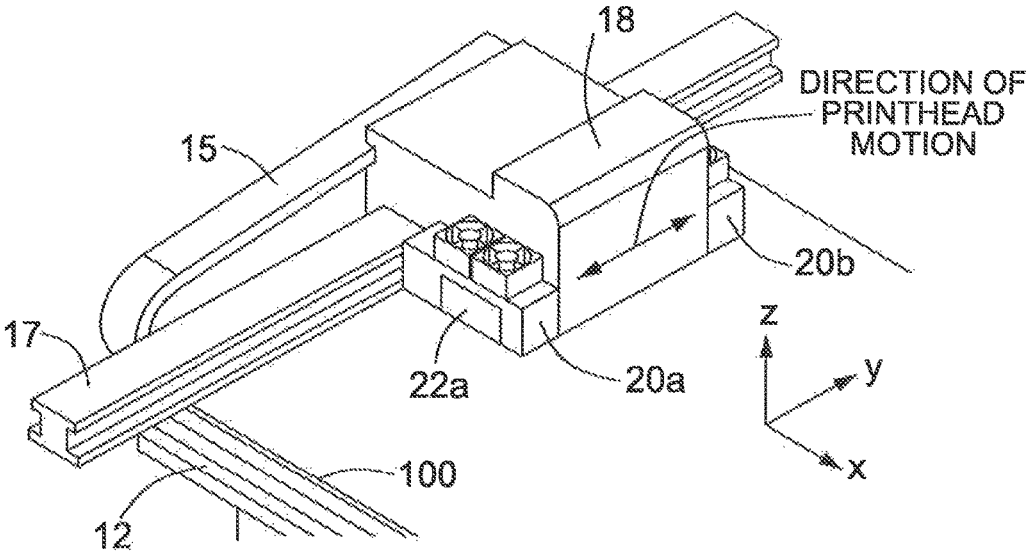
FIG. 1A shows a UV inkjet print head arrangement with a scanning print head.

For example, FIG. 1A shows a typical configuration for a scanning UV inkjet printer setup where the print engine comprising the print head 18 and the lamp heads 20*a* and 20*b* carry adjustable lamp head assemblies 22*a* and 22*b*. For reference, xyz axes are indicated in the figures, to assist in describing the relative motion of the parts. The print head 18/lamp head 20, powered through flexible control cable 15, move together along a fixed guide rail 17, to and fro, along they axis across the substrate 100, jetting ink and exposing the ink 102 to UV irradiation, over a band or slot of the substrate exposed under the lamp heads 20*a* and 20*b*. In general, after one or more scans, the substrate advances (is moved) one step size or slot width in the direction of x. The step size (slot width) is typically determined by the printer manufacturer, to match the jetting patterns of the inkjet print head, and is in general between 1 cm and 5 cm. Thus, in this range, the step size is smaller than the illuminated beam width in the x direction, in order to print and cure the next slot or band of jetted inks.

Figure 1B:
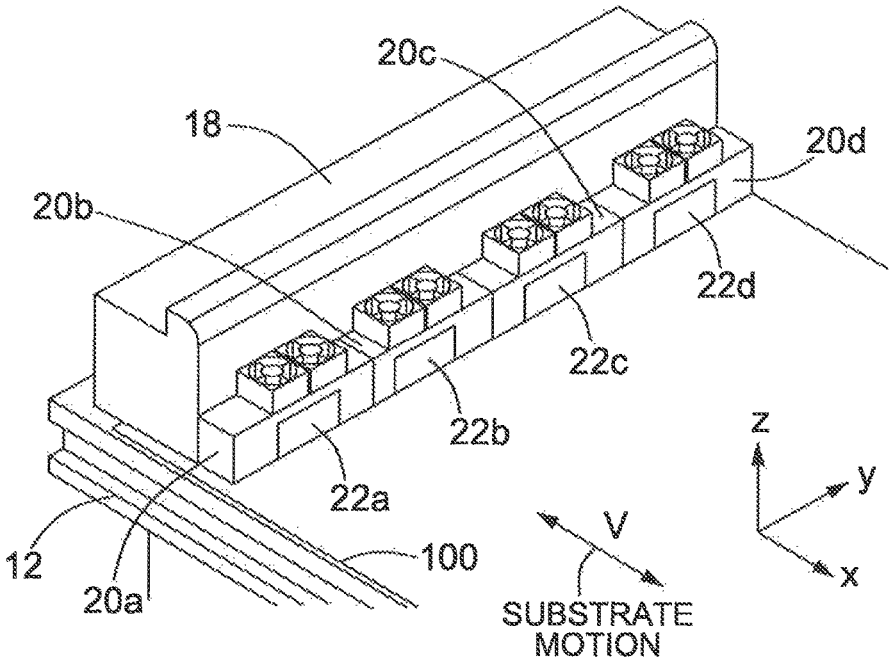
FIG. 1B shows a UV inkjet print head arrangement with an array of fixed print heads.

FIG. 1B is another typical configuration for a UV inkjet printer with a fixed print head 18 and four UV curing lamp heads 20*a*, 20*b*, 20*c* and 20*d*, extending across the transverse direction of the substrate 100 to cover the whole substrate width in the y direction. This arrangement, in which the substrate 100 is moved in the x direction, under the fixed print heads 18 and UV lamp heads 20*a*-20*d* extending across the transverse y direction of the substrate, may allow for single pass printing if the ink jetting speed and curing speed are fast enough.

In general, for a rectangular exposed area 26, a beam profile may be characterized by a dimension L, along a length of the lamp tube, and an exposed width W perpendicular to the beam length, and an intensity I as a function of L and W. In the embodiments described herein, the intensity profile is preferably uniform in dimension L of the UV lamp (i.e. corresponding to the x axis in FIG. 1A, and they axis in FIG. 1B. That is, in FIG. 1B, the lamp head orientation is rotated 90 degrees relative to the same axes in FIG. 1A). Since the relative movement between the lamp head and the substrate is usually perpendicular to the dimension L, the beam intensity profile I(w) along the other dimension W, that is, along the direction of relative movement of the substrate 100 during UV exposure (i.e. they direction in FIG. 1A and x direction in FIG. 1B) is more important in determining the temporal exposure of the substrate. Moreover, since a minimum intensity is required for effective curing, the total exposed width W of the exposed area is less important than the beam width having an intensity sufficient to achieve curing, i.e. an intensity above a saturation level $I_s$. Thus, in this application, a beam width, $W_s$ will be defined which is the optical beam profile width with intensity higher than the saturation level $I_s$. Referring to FIGS. 1A and 1B, this is the beam width $W_s$, i.e. along the direction of relative motion between the UV sources and the substrate during curing. Thus, $W_s$ is usually smaller than the total exposed area width W.

Figure 2:
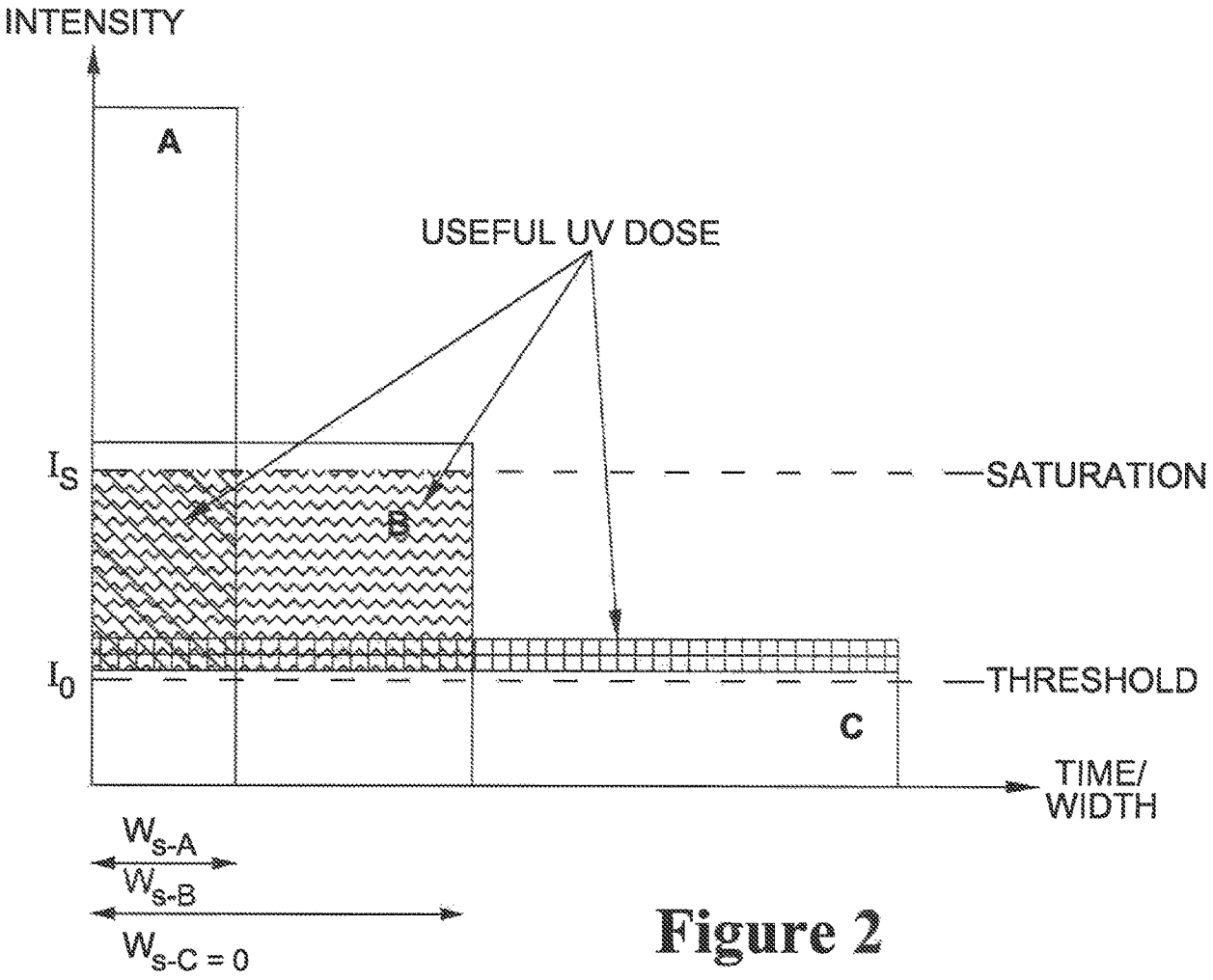
FIG. 2 shows a schematic diagram showing simplified models of beam profiles for UV curing: (a) a very low intensity broad beam; (b) a preferred profile for higher curing efficiency; (c) a very high intensity narrow beam.

Schematic representations of three simplified beam profiles for UV curing are shown in FIG. 2. Profiles A, B, C represent different approaches to achieve different curing efficiency. Each of rectangular blocks representing the beam profiles A, B, and C have the same area, and thus the doses delivered by profiles A, B and C to the UV curable materials are same. As mentioned above, it is well known that to initiate polymerization, the UV illumination profile must exceed a minimum threshold level, $I_0$. However, typically there is also an upper threshold or saturation level $I_s$ above which efficiency of curing does not increase significantly.

Referring to FIG. 1, Profile C is representative of a profile (i.e. intensity as a function of beam width W) with very low intensity just above $I_0$ with a wide profile $W_{s-C}$, i.e. longer illumination time at lower intensity, such as taught for the pre-cure part of the profile disclosed in U.S. Pat. No. 3,983,039. In this example, UV photons below the threshold $I_0$ are not effective in creating polymer chains, instead they are used for oxygen consumption, and only a small proportion of incident photons are effective in the polymerization or curing reaction, again resulting in low efficiency. In this example, although the exposed beam profile is wide, the beam width $W_{s-C}$ above saturation intensity $I_s$ is effectively zero.

Profile A is representative of a very high intensity, narrow beam of width $W_{s-A}$, resulting in a short illumination time, which is typical of that taught in U.S. Pat. No. 5,945,680, to effect high cure rate. Although a large photon dose is delivered to the substrate, only a portion of the illumination falls between the threshold $I_0$ and saturation level $I_s$. Light above the saturation level is wasted, resulting in low efficiency of curing.

Profile B, in FIG. 2 shows a simplified preferred beam profile to be generated by an apparatus according to an embodiment of the present invention. Since photons above the threshold level but below the saturation level for a particular material are considered most efficient for polymerization, and photons above a saturation level are wasted, the desired beam profile B has a proper intensity around the saturation level and a beam width $W_{s-B}$, which allows illumination time greater than induction time, to provide effective UV curing.

In comparing three Profiles A, B, and C with the same photon dose, it will be apparent that the Profile B should have the highest curing efficiency with the most useful UV dose in the range between threshold and saturation, contributing to polymerization, and being delivered in a time scale appropriate for the reaction kinetics and process speed of the particular ink and substrate being processed. Consequently, embodiments of the present invention provide an apparatus for UV curing and a lamp head assembly for UV curing which provides an adjustable beam profile so that the UV illumination can be adjusted and optimized dependent on process parameters such as print speed, and factors which are dependent on ink chemistry, e.g. induction time, to achieve a beam profile to obtain improved curing efficiency in ultra-fast processing.

Referring to FIGS. 3 to 8, a system, a method and an adjustable lamp head for high speed UV curing according to an embodiment of the present invention will now be described, which provide for achieving improved or optimized curing efficiency according to the process needs, in a time scale that is slightly longer than the induction time for UV curing. In particular, the desired results are achieved by using a system comprising an adjustable lamp head assembly 22 to produce a special beam profile optimized for the UV curing process.

As mentioned above, UV curing processes in air have to overcome oxygen inhibition effects to achieve a satisfactory curing quality. To meet the demands of higher productivity, the print speed, i.e. the relative speed between the curing light source and substrate becomes higher and higher. This pushes the illumination time closer to the induction time, which is required as a minimum illumination time to effect curing. There are two sources of oxygen to be considered: the residual oxygen in the UV curable material or ink, and the diffused oxygen from the atmosphere or external environment. The residual oxygen in the ink can be consumed by a high intensity UV light in a reasonably short time period from <0.01 s to 0.1 s, dependent on quantum yield, absorbed dosage, and light intensity. However, oxygen diffusion is a dynamic process that will slow down when the viscosity of the bulk material being cured increases, because of the chain reaction in photo-polymerization. Such a chain reaction takes certain amount of time, which is in the sub-second range, to build a network in the bulk material with viscosity high enough to compete with oxygen diffusion from outside. Traditional methods of increasing the light intensity for high speed UV curing processes may consume residual oxygen if the UV exposure is sufficiently long. However, for ultra-high speed processing, when the available exposure time is close to, or even less than the induction time, increasing light intensity fails to provide satisfactory curing quality. Thus light is not effectively utilized for curing, and results in low system curing efficiency. Consequently, conventional approaches to increasing efficiency by increasing light intensity e.g. Profile A (FIG. 2) fail to resolve the issue of losing curing efficiency when the illumination time is less than the induction time.

To reduce this problem, apparatus and methods according to embodiments of the present invention, are provided for controlling the UV beam profile to achieve higher curing efficiency. The beam intensity and beam width are adjusted to deliver the required UV dose over an increased exposure time. It is still preferred that the light intensity is higher than a certain minimum threshold $I_0$ and close to a saturation level $I_s$ to keep the whole system efficiency, but the intensity and width $W_s$ of the beam profile is adjusted to increase the exposure time to be greater than the induction time. The threshold and saturation values depend on the UV curable material and other process requirements.

Figure 3:
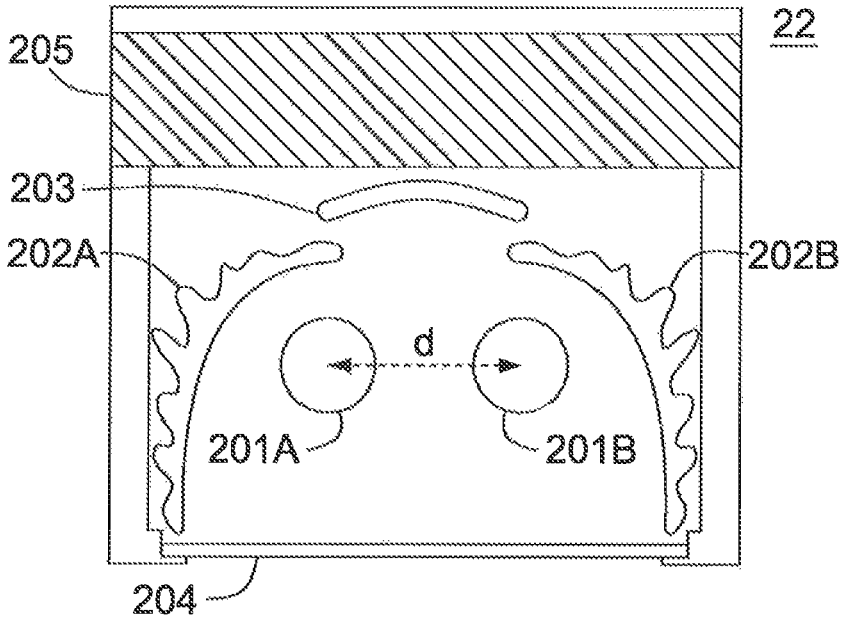
FIG. 3 shows a schematic cross-sectional diagram of a lamp head according to a preferred embodiment of the present invention, comprising two lamps.

FIG. 3 shows a cross-sectional view of a lamp head assembly 22 for a UV curing system 10, such as illustrated in FIG. 1, according to a preferred embodiment of the present invention. The lamp head assembly 22 comprises two UV lamp tubes 201A and 201B, two side reflectors 202A and 202B, an optional top reflector 203, a quartz plate window 204, a cooling mechanism 205 and power connections (not shown), mounted in a lamp head 20. The intensity of the two lamp tubes 201A and 201B may be independently adjusted, and the distance d between the lamp tubes 201A and 201B can be adjusted to produce beam profiles of different widths. The relative positions of the lamp tubes 201A and 201B, and side reflectors 202A and 202B can also be adjusted to produce a preferred optical profile for certain curing applications. Thus, a beam profile of a desired width and intensity may be provided for different curing applications. When the desired optical profile is wide, the two side reflectors 202A and 202B are spaced apart to leave a gap between the top parts of the reflectors; a top reflector 203 is usually needed to prevent a large amount of light loss from such a system. It is also preferred to have the top reflector 203 built as a separate component from the two side reflectors 202A and 202B, so that there are proper ventilation paths between the side reflectors 202A, 202B and the top reflector 203. Also, the side reflectors 202A and 202B can be movable, i.e. may be tilted, rotated, or otherwise relatively moved, and may act as a shutter, to provide an adjustable beam profile. The reflective surfaces of the side reflectors 202A and 202B are preferably of partial elliptical or parabolic shape, or variations of such. Since the size of the lamp head is typically constrained by the size and form of the print head 20 of the UV curing/printing apparatus, the construction of the lamp head assembly 22, and in particular the lower edges of the side reflectors 202A/202B, are preferably built in such way that the lamp head assembly will produce the widest optical profile that is possible at the preferred working distance h from the substrate. Usually the working distance of the lamp assembly to the substrate (h in FIG. 1) is fixed. To prevent stray light from curing unjetted inks inside the print head, most of the working distances are 5 mm or less. Adjustment of the working distance within such range only provides for a small change of the optical profile. So it is not preferred to adjust working distance. Instead, a change in optical beam profile is accomplished by adjusting the height of bulbs and/or side reflectors inside the lamp head. A quartz plate or window 204 is provided to protect the lamp from dust and ink droplets. The width of the plate 204 and the clamping mechanism for fixing the quartz plate 204 should not significantly limit the maximum width of the optical profile from the lamp head assembly. The cooling mechanism 205 may be air cooling or liquid cooling, as is conventional, for providing proper thermal management for UV lamps for such a curing system.

Figure 4:
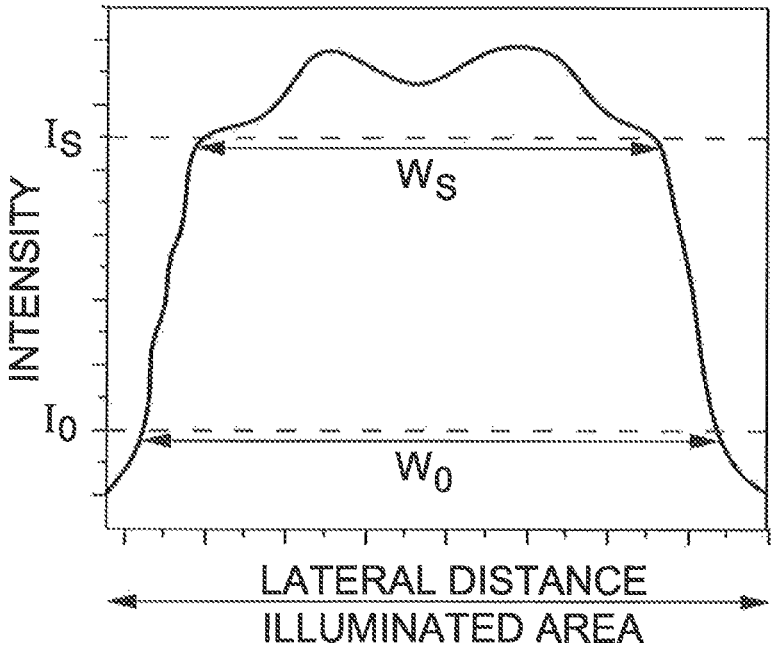
FIG. 4 shows a lateral optical profile generated by a lamp head assembly as shown in FIG. 3 wherein twin lamps comprise two identical lamps running at the same power level.
Figure 5:
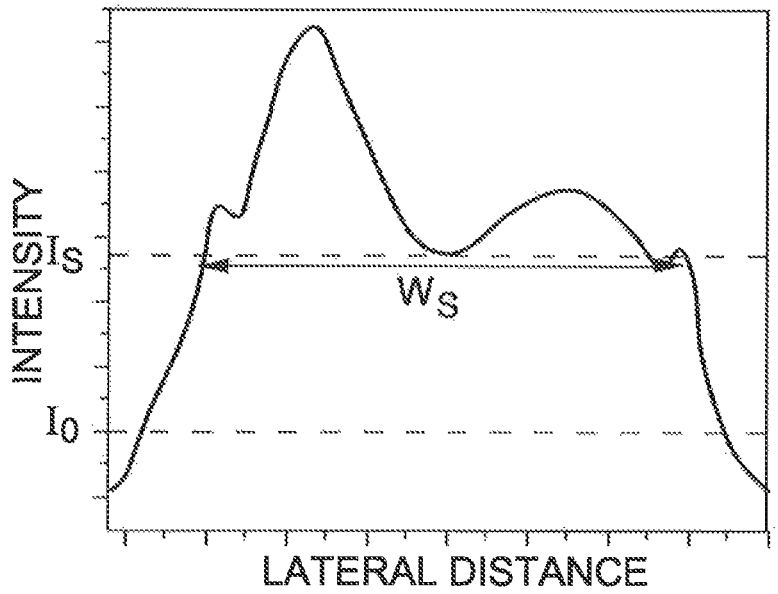
FIG. 5 shows a lateral optical profile generated by a lamp head assembly as shown in FIG. 3 wherein twin lamps comprise two lamps running at different power levels.
Figure 6:
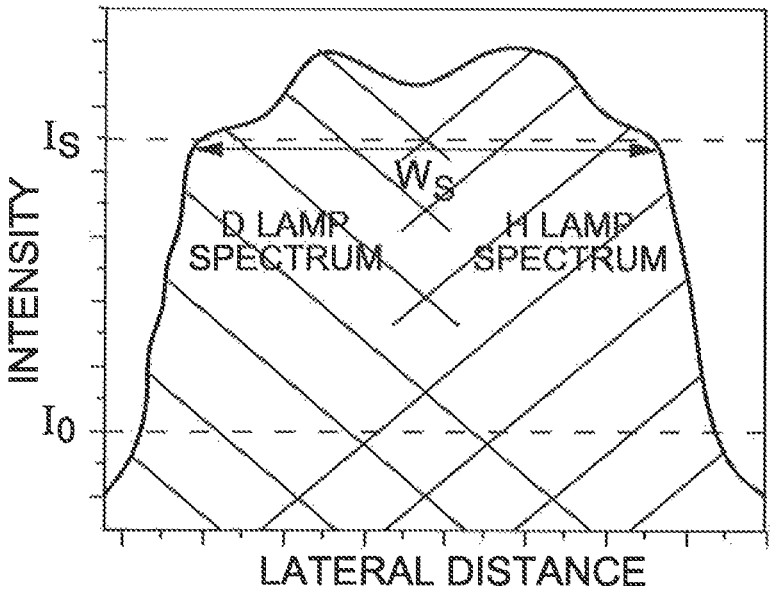
FIG. 6 shows a lateral optical profile generated by a lamp head assembly as shown in FIG. 3 comprising two different types of lamps for a beam profile having a spatial distribution comprising different spectra.

In a dual lamp head assembly as shown in FIG. 3, two identical twin lamps may be provided, or, for example, each lamp may provide a different spectrum. FIG. 4 shows a beam profile generated by a lamp assembly as shown in FIG. 3, comprising two identical UV lamps operated at the same intensity. For comparison with the profile in FIG. 4, two other profiles from a dual lamp head assembly are shown in FIGS. 5 and 6. Each profile provides a broad beam profile of similar width $W_s$. FIG. 5 shows the profile of the same two lamps when operated independently at different intensities. FIG. 6 shows a profile generated when the dual lamp assembly comprises one lamp having a D lamp spectrum and one lamp having an H lamp spectrum, operated at the same intensities. Each of these profiles may be further adjusted by adjusting lamp parameters including power, intensity, lamp separation distance, reflector position, etc., as shown in more detail in FIG. 7.

The system differs from conventional UV curing systems because the lamp head assembly 22 comprises adjustment means, i.e. an adjustment mechanism 40 for the lamps 201A and 201B, and other optical elements, i.e. reflectors 202A, 202B and 203 and a connection to control means 30 for adjusting the lamp parameters to provide a desired beam profile. The adjustment mechanism 40 may be controlled by a beam profile controller 34 of the UV curing system (see FIG. 1). The adjustment mechanism 40 of the adjustable lamp head 22 of FIG. 3 is shown in more detail in FIG. 7 and comprises the reflector rotation controller 42, the reflector linear motion controller 44, the bulb up/down linear controller 46, and the bulb left/right linear controller 48. These lamp adjustment mechanisms are designed to adjust the lamp head to a variety of different configurations to produce different optical beam profiles. The implementation of these mechanisms may be a combination of the general purpose mechanical setups for making rotation and/or linear motion control. For example, the reflector rotation controller 42 may be a pair of gears that engage with each other and rotate in opposite directions. Linear motion controllers, 44, 46, and 48 may be linear slides that are combined to produce 2D linear motion of the optical elements. The lamp parameters are preferably automatically controllable by the system. In this case, the typical input is the default optical profile as described in the flowchart of FIG. 8 and defined by the default beam profile width $W_D$. $W_D$ is calculated from ink parameters, oxygen concentration, and process speed requirements. Alternatively, the lamp parameters may be set manually by an experienced operator. For example, after a couple of trials, an operator with ordinary skills may become familiar with the profile width requirements for typical ink sets and can set the lamp head parameters to produce the preferred optical profile to achieve highest curing efficiency.

Figure 7:
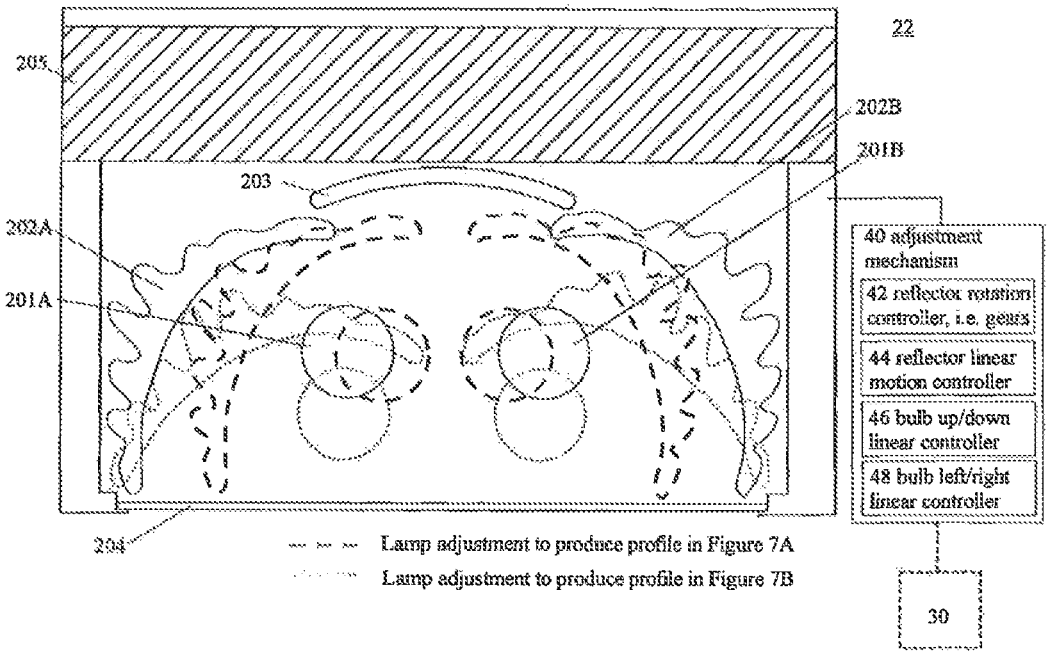
FIG. 7 shows a schematic diagram of the adjustment mechanism of the lamp head assembly of FIG. 3.
Figure 7A:
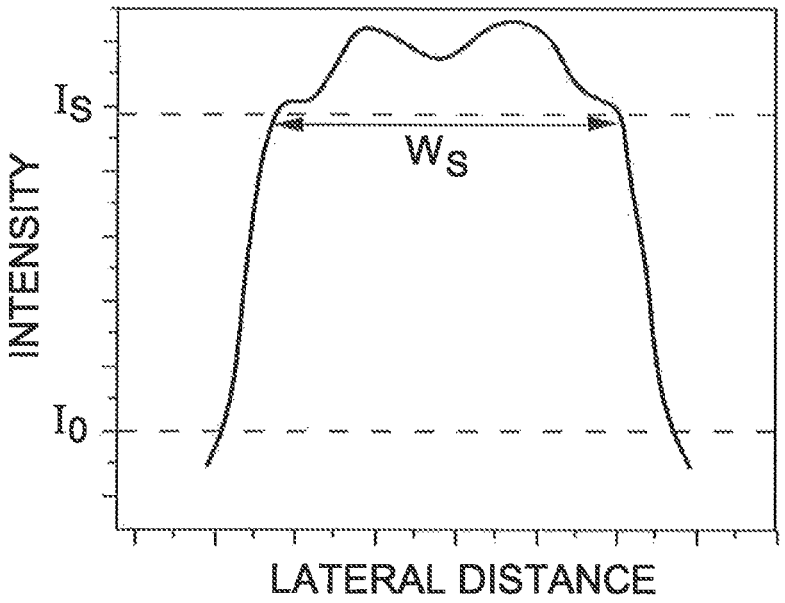
FIGS. 7A and 7B show two representative profiles from adjustment of lamp parameters.
Figure 7B:
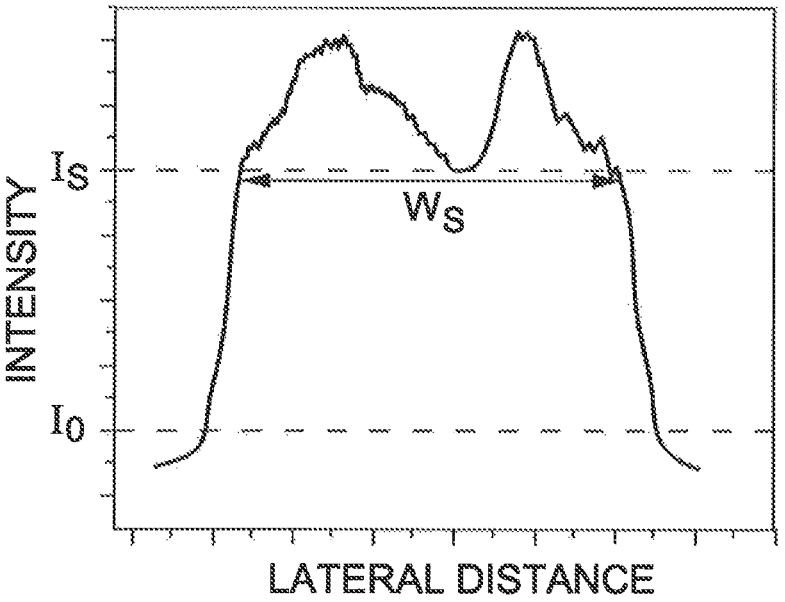

As examples of beam profiles that may be generated by adjustment of lamp parameters of the lamp head assembly 22, FIGS. 7A and 7B show two different beam profiles A and B, which may be produced by adjusting elements of the lamp assembly shown in FIGS. 3 and 7, when different parameters of the lamp assembly are adjusted, e.g. lamp source spacing, reflector position and tilt angle. In the example illustrated by FIG. 7A as a variation from FIGS. 3 and 4, both lamp bulbs are adjusted closer to each other and the two side reflectors are also adjusted closer to produce a profile where the total power is kept the same but the beam profile width varied. In another example illustrated by FIG. 7B as a variation from FIGS. 3 and 4, the lamp bulbs are moved closer toward the quartz plate for higher peak irradiance and the two side reflectors are tilted to keep a maximum profile width. By dialing up, i.e. increasing lamp power, one may also create varied optical profiles with increased peak irradiance and width and/or spatial variation of the profile intensity.

In operation of a UV curing system such as shown in FIG. 1 with an adjustable lamp head assembly 22 as shown in FIGS. 3 and 4, to optimize a beam profile for UV curing of a particular ink and substrate combination, an initial set-up operation is required to determine a preferred beam profile for optimizing curing efficiency. Steps in a process for determining a preferred optical profile based on different process requirements are shown schematically in the flowchart in FIG. 8. For a given lamp head assembly, and lamp power/maximum intensity, the beam profile is primarily determined by the width $W_s$ of the beam profile, which determines the exposure time, according to print speed, and other process requirements. The beam width may be adjusted by moving reflectors 202A and 202B. For a particular beam profile shape, the (peak) intensity may be set dependent on the threshold and saturation level requirements for the material being cured.

Initially, lamp parameters for a default profile, or an initial lamp profile for the particular combination of ink/coating and substrate being cured, are input via beam profile controller 34 to adjustment means 40 of the lamp head assembly 22. The desired width of the profile is calculated based on the induction time, which is determined by material to be cured, oxygen concentration, curing speed, and other requirements according to the description above. A sample cure trial is performed and followed by monitoring or testing and review of the cure result. The general practice of evaluating cure results may include visual examination, and/or some automatic tests using for example FTIR (reflectance and/or transmittance) or another type of spectrometer, a gloss meter, or a calorimeter. A calorimeter may be used to measure heat quantity variations, which are associated with polymerization reactions. If required, parameters of the lamp head assembly 22, such as lamp spacing, or reflector position, and/or intensity are adjusted to adjust the beam profile, i.e. to change the beam profile width, and/or intensity. A sample cure trial and cure result review is repeated as required, if the cure result can still be improved, i.e. until cure requirements or metrics for the desired level of curing efficiency are met or fall within the desired limits. Thus, the beam profile may be set so that the light source provides the required intensity relative to threshold and saturation values, and for the required duration for efficient UV curing at a particular process speed. The beam profile may be adjusted to an optimum curing efficiency for each particular light source and process pair (coating/ink and substrate).

Initial set up and adjustment of beam profile parameters may be required for each process, e.g. starting with a default profile, followed by iterative testing of cure results using several different beam profiles as described above. Alternatively, parameters for specific processes, i.e. a specific ink and substrate combination, may be predetermined, so that these may be stored, and input into the beam profile controller to determine initial settings of lamp parameters for a particular system and lamp head assembly. If a set of preset lamp profile parameters and adjustments are provided to set up a new print process, only fine tuning of the lamp profile parameters may be required to adjust the beam profile, to obtain consistent print quality from run to run.

EXAMPLES

Determination of Lamp Head Settings to Produce an Optimized Optical Profile in Order to Achieve Highest (Optimum) Efficiency in High Speed UV Curing As described above, since one of the primary problems in ultra high speed curing is the illumination time approaches or is less than the time period required by oxygen consumption reactions, one of the objectives is to link the induction time period, to the process parameters. The oxygen has to be consumed before the polymerization can start, i.e. $[O_2] \leq [R^*] = r_i \times t_i$. The rate of generating initiating radicals $r_i$ is given by $r_i = \Phi \times I_{abs}$, where $\Phi$ is the quantum yield and $I_{abs}$ is the intensity absorbed in the sample. With $I_i$ being the incident UV light intensity and $\varepsilon$ the molar extinction coefficient of the photo-initiator, [PI] the photoinitiator concentration and I the optical length, $I_{abs} = I_i(1-\exp(-\varepsilon[PI]l))$. The induction period is then written as $t_i[O_2]/[\Phi I_i(1-\exp(-\varepsilon[PI]d))]$. With a known relative speed between the light source and substrate, v, the optimal optical profile width, $W_s$, which determined the minimum illumination time can be derived, $w_s = v^* t_i$. The profile width is defined as the beam width with light intensity above the saturation level $I_s$, as illustrated schematically in the Figures. Such a definition of profile width $W_s$ is not generally used in the industry. Since the existence and importance of a saturation intensity in UV curing is not generally recognized, there has not been a standard definition profile width in UV curing for arbitrary profile shape. Given a specific lamp assembly and light source, and a process of UV curing with certain speed requirement, optimal profile width information determined by the method of the present invention can be fed into the system to setup lamp head parameters in order to produce the desired profile for the highest or optimum curing efficiency.

Example 1

Figure 13:
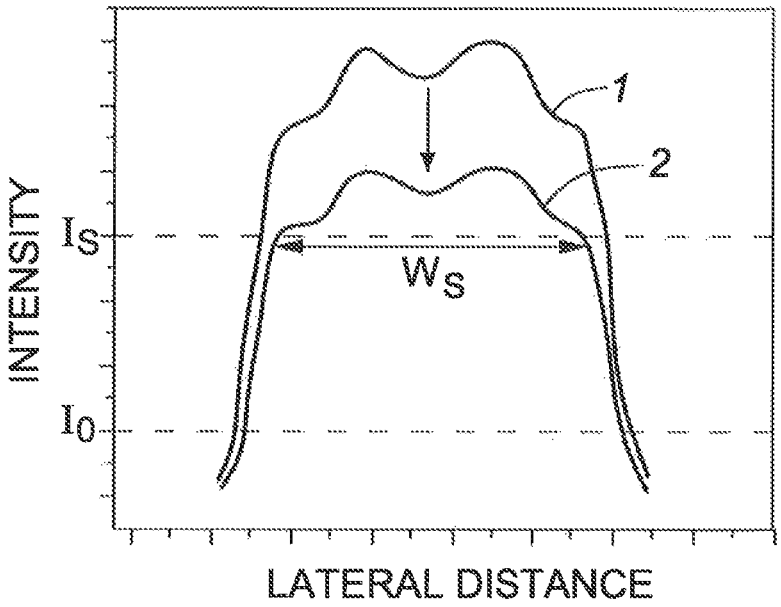
FIG. 13 shows two beam profiles of similar beam width $W_s$, and different intensities, generated by the lamp assembly shown in FIG. 7.

Given one specific example of using a curing system with two lamps in the lamp head to cure SunChemical CRYSTAL® UFE ink set, one may obtain the information regarding to ink chemistry parameters such as: $[O_2]$, $\Phi$, $\varepsilon$, [PI] from standard tests, from the ink supplier, or from literature in public domain. Because of the thin ink layers, I can be the thickness of the ink layers. By taking draw down curing tests on ink films at the thickness of 1, it is fairly easy to determine a threshold level of light intensity, $I_0$ below which ink is not highly reactive. These parameters can be used to calculate a default induction time, which yields a default optical profile width, $w_0$ by multiplying the process speed, v. With the initial width, $w_0$ and the maximum lamp intensity provided by the curing system, one may define a default beam profile. By adjusting lamp distance between the lamps and the positions of the reflectors, as described with reference to FIG. 7, the curing system can be set to produce the default beam profile with a specific width $W_s$ to do some curing trials on printers with the specified process speed. If these trials yield good print quality, the lamp power is reduced, which effectively lowers the intensity, but keeps the beam width almost the same (see FIG. 13). Curing trials are repeated on the printer with intensity lowered step by step until a noticeable print quality change is seen, to determine the lowest intensity providing an acceptable print quality. Thus, assuming the default beam profile has a beam width $W_s$, wide enough for high speed cure, but having a peak intensity that is way above required threshold, in order to achieve highest curing efficiency, the power is dialed down (i.e. reduced a step at a time) so that the profile intensity is brought closer to the threshold and good print quality is maintained. Then the intensity setting and profile width, $W_s$ are considered to be the optimal beam profile for such process. For example, as shown in FIG. 13, Profile 1 has a beam profile width $W_s$ and an intensity significantly higher than the saturation level $I_s$ over the beam width $W_s$; energy in the region of the beam profile above the saturation intensity $I_s$ may not be used effectively. By reducing the lamp power, the peak intensity is brought down, as shown in FIG. 13, Profile 2, so the beam width is only slightly reduced, maintaining almost the same exposure time, but less energy falls in the region above the saturation level $I_s$. Thus, Profile 2 of FIG. 13 results in more efficient use of available energy for curing.

Figure 14:
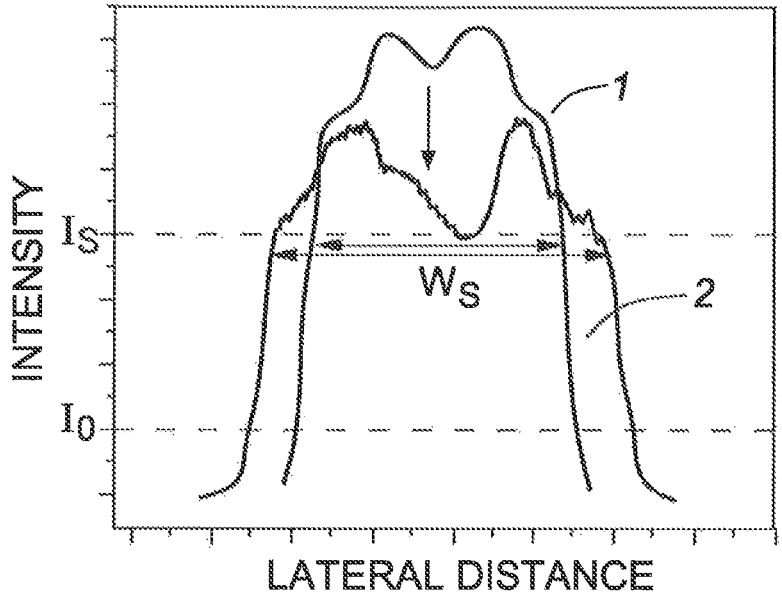
FIG. 14 shows two beam profiles of different beam width $W_s$, but similar dose, generated by the lamp assembly shown in FIG. 7.

If the initial trials starting with a default lamp profile do not yield good print quality, the lamp power is maintained the same, and the beam width $W_s$ is increased, which effectively lowers the peak intensity, and increases the exposure time, while delivering the same photon dose. FIG. 14 shows one example of changing from a Profile 1 with high intensity but narrower width to a more efficient Profile 2 with high enough intensity above the saturation level $I_s$ but wide enough profile $W_s$ for high speed curing. The photon flux per unit area is reduced, but the same dose is delivered since the exposure time is increased, by increasing the beam width $W_s$.

Figure 8:
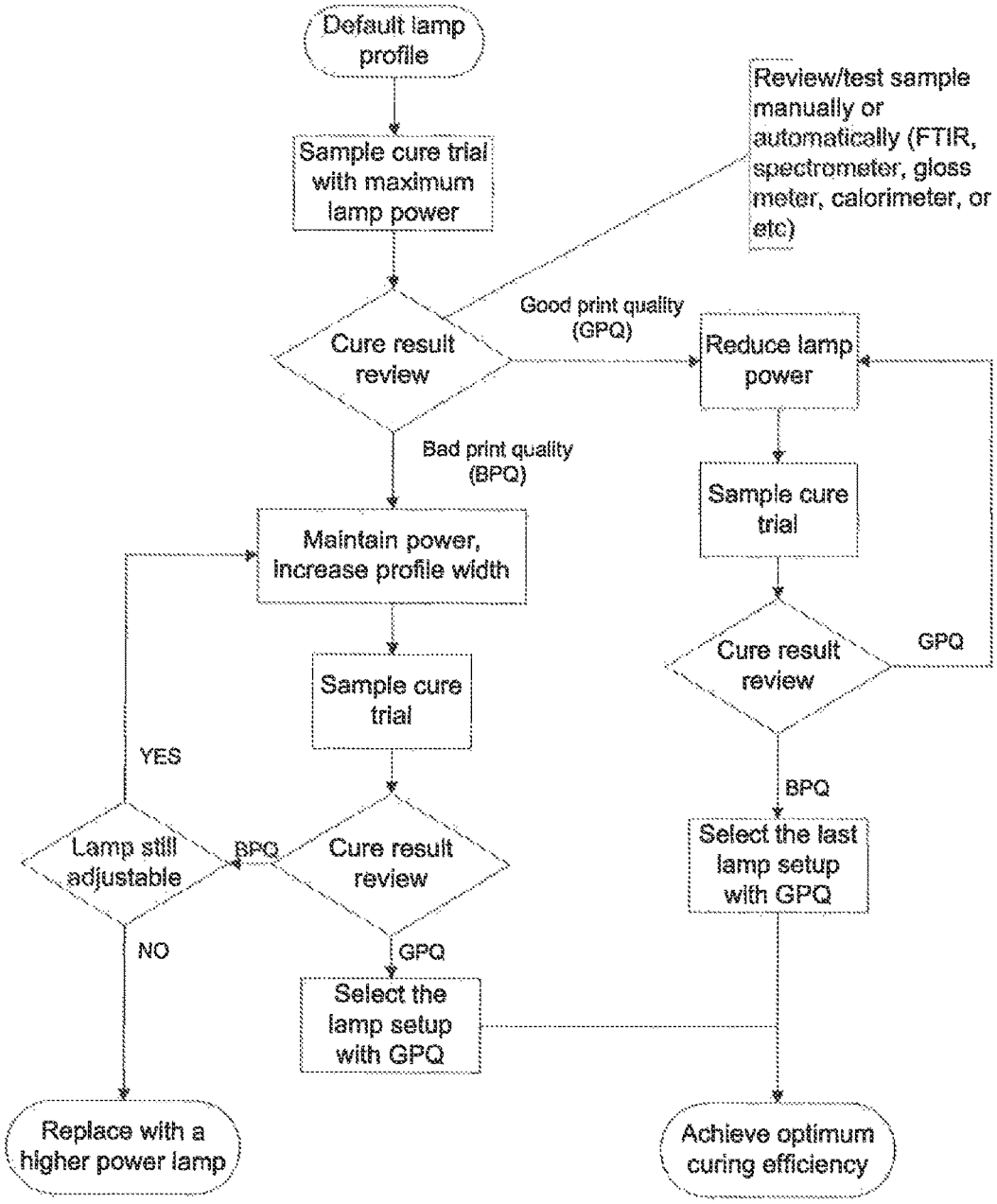
FIG. 8 shows a flowchart depicting steps in a method according to an embodiment for determining an optimal lamp profile for higher curing efficiency.

In general the system may step through a preset range of parameters to conduct a test sequence as shown schematically in the diagram in FIG. 8. Thus the system will readjust the lamp distance and reflectors to produce the new profile for additional trials, continuing to increase beam width and lowering the intensity step by step until one receives good print quality. Alternatively, a test sequence may be set and carried out by an experienced operator. Once parameters for good print quality are determined, then the beam width and intensity level are set to define the optimal beam profile for such process. In the case that acceptable print quality is not obtained, a curing system with higher power may be required.

In one of the examples used to test the curing efficiency, the width and height of the intensity profile from the lamp head 22, as shown in FIG. 7, can be adjusted, for example, to provide beam profiles as shown in FIG. 14, so that the total energy delivered from the lamp is the same from two Profile settings 1 and 2. However, at the process speed of ~1.9 m/s, with Profile 1 (narrow beam with much higher intensity) was not able to cure the ink film properly after a single scan Referring to FIG. 14, this type of profile provides a narrow beam profile with a much higher photon flux exceeding a threshold value $I_s$. On the other hand, Profile 2 spreads the same energy or photon flux over a wider beam profile, and is characterized by a wider but relatively lower intensity beam. Profile 2 provided an excellent cure compared with Profile 1. As apparent from Figures comparing Profiles 1 and 2 shown in FIG. 14, excess energy (i.e. photon dose) in regions of the Profile 1 above saturation is redistributed in Profile 2, so the energy is spread over a greater width of the beam profile, below the saturation level $I_s$, so that the available energy (photon dose) is used more effectively in curing.

In the lamp head assembly shown in FIGS. 3 and 7, two conventional tubular UV arc lamps are illustrated. It will be appreciated that in alternative embodiments, the lamps 201A and 201B can be one or more of other types of arc lamps, microwave lamps, a UV LED array, a UV laser diode array or other kind of UV sources, i.e. arranged in a lamp head assembly of a suitable form factor to fit into a conventional print head, as will now be described with reference to FIGS. 9 to 12.

Figure 9:
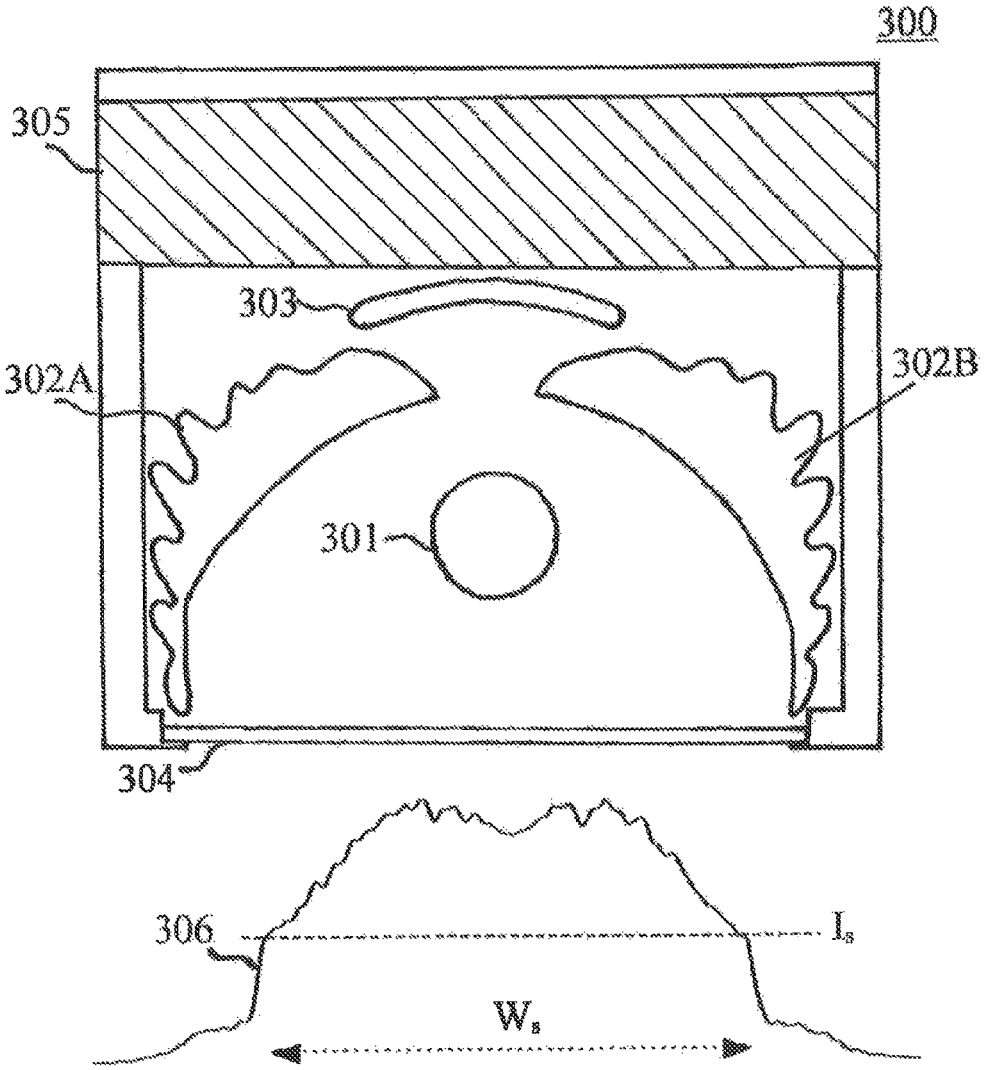
FIG. 9 shows a schematic diagram of a cross section of lamp head assembly according to another embodiment of the present invention, comprising one lamp, and a corresponding sample beam profile.

Thus, for example, a lamp head assembly providing an adjustable beam profile according to another embodiment, as shown in FIG. 9, comprises a single light source, e.g. one UV arc lamp, and FIG. 9 also shows a corresponding lamp profile. The lamp head assembly includes one single UV lamp 301, but otherwise this lamp assembly is similar to that shown in FIG. 3, and comprises two side reflectors 302A and 302B, one optional top reflector 303, one quartz plate 304, cooling mechanism 305 in one lamp head. Lamp 301 may be an arc lamp, microwave lamp, UV LED array, UV laser diode array or other kind of UV source. The relative positions of the lamp 301 and side reflectors 302A and 302B can be adjusted to produce a preferred optical profile for certain curing applications. Because of the wide optical profile, the two side reflectors 302A and 302B are usually kept far away from each other, which leaves a certain gap at the top, so a top reflector 303 is usually needed to prevent large amounts of light loss from such a system. As in the embodiment shown in FIG. 3, it is preferred to have the top reflector 303 built as a separate component from the two side reflectors 302A and 302B such that there are proper ventilation paths between the side reflectors 302A and 302B and the top reflector 303, meanwhile the side reflectors 302A and 302B can be movable acting as a shutter or producing a profile variable UV curing system. The reflective surfaces of the side reflectors 302A and 302B are preferred to have a curve of partial elliptical or parabolic or variations of such. If the side reflectors 302A and 302B create an elliptical shape, it is preferred that the lamp 301 is not placed on the focus point in order to create a wide beam profile 306. Other elements, i.e. quartz plate 304 and cooling means 305, are provided, which are similar to corresponding elements shown in FIG. 3. This arrangement is simpler and has fewer elements than the embodiment shown in FIG. 3, and thus provides fewer lamp parameter adjustments and less control over the beam profile. However, the lamp head assembly 22 and control means 50 are simpler, and this embodiment may be a preferred lower cost alternative for some applications, or if a wider range of beam profile control is not required.

As described above, a preferred embodiment of the lamp head comprises two conventional UV lamps, but in other embodiments, other configurations comprising two or more lamps, or groups or arrays of LEDs, provide for alternative beam profiles.

The preferred embodiment of the lamp head assembly shown in FIG. 3 with two identical lamps will generate an optical profile similar to the one shown in FIG. 7. The beam profile width, which can be adjusted by changing, for example, the distance between lamps or reflector position, is determined based on the UV curable material, and more particularly the induction time for the curing process. Such a multiple lamp system is more efficient than a conventional single lamp system, which can typically generate a narrower beam profile providing an illumination time close or even less than the induction time. The advantages of multiple lamp system are more apparent in applications that require ultra high speed processes. Another advantage of a multiple lamp system is the heat dissipation rate increases because the heat dissipation surface area is significantly increased, which helps in thermal management of such light sources.

Furthermore, in a dual lamp or multiple lamp system, by dialing up the power of one lamp, the beam profile can have not only a total beam width $W_s$ wide enough to provide long enough illumination time, but the beam profile may also have a higher peak intensity over part of the beam width. Such beam profile (e.g. as shown in FIG. 5) has special benefits for applications that suffer from surface cure problems, to provide a boosted peak intensity, for additional surface cure.

In another alternative embodiment, the lamp head assembly comprises a dual lamp assembly with two different lamps. Generally speaking, H-lamps have more UVC output than D-lamps. With the short wavelength, UVC light has short penetration depth into material so generally H-lamps usually have more advantages for surface cure than D-lamps. By using different type of UV lamps in one lamp head as shown in FIG. 3, the beam profile has a similar width and shape as that shown in FIG. 4, but the spectral distribution (FIG. 6) is different, and may provide additional surface cure because of the added H-lamp spectrum.

When multiple light sources are used in one lamp head assembly, for example, in an LED array comprising a plurality of LEDs, the light sources may be addressable as described in U.S. Pat. No. 6,683,421 assigned to the present assignee, to enable control of power to individual lamps, or groups of lights sources (LEDs), to control the beam profile accordingly.

Figure 10:
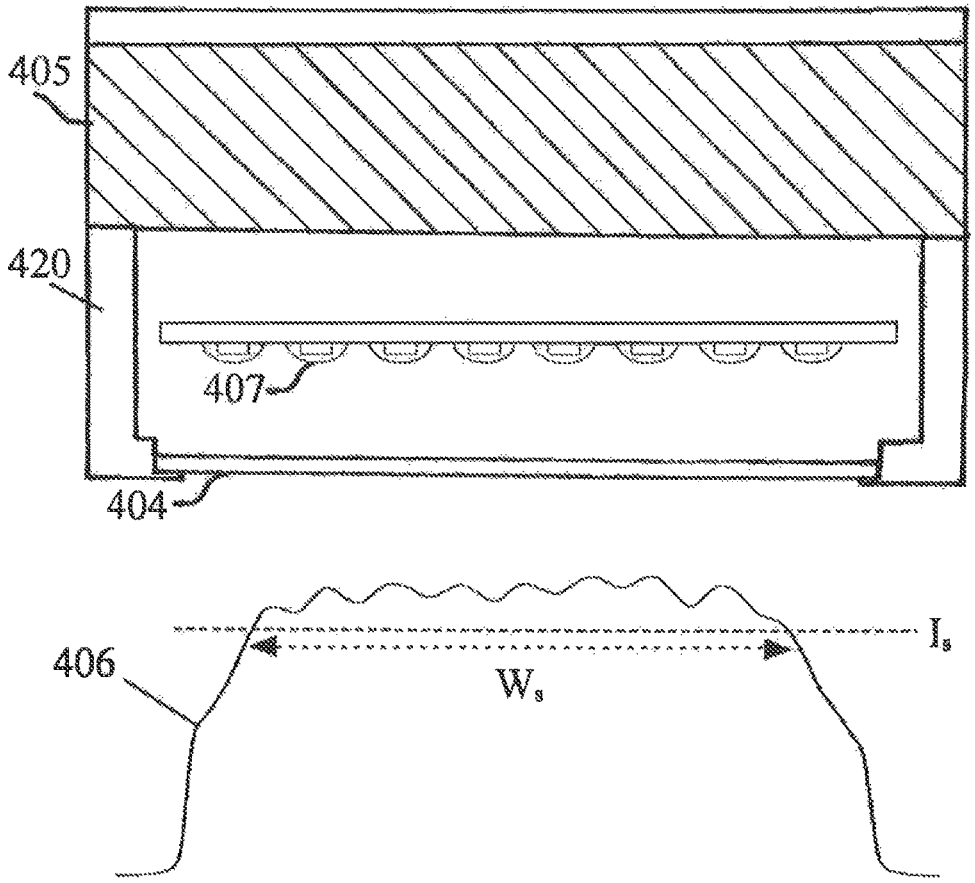
FIG. 10 shows a schematic diagram of a cross section of a lamp head assembly comprising at least one addressable LED array to produce an adjustable beam profile to satisfy process requirements.

FIG. 10 shows another embodiment of the present invention that has addressable LED arrays 407 to produce an adjustable optical beam profile required by different process needs. The device includes a housing 420 and LED arrays 407 having a light output wavelength suitable for initiating a photoreaction. The LED arrays 407 are cooled by a cooling mechanism 405, which could be air cooling or fluid cooling depending on the power level of the LED arrays 407. The LED arrays 407 may comprise optical elements (not shown) such as reflectors, refractors, micro-lenses and/or coatings or encapsulants, to direct or collimate light, e.g. as described in U.S. Pat. No. 6,683,421. The lamp head is usually equipped with a quartz plate 404 to block dust and ink droplets. The device also includes a power source (not shown) for providing power to energize the array 407 and a controller (not shown) coupled to the power source for varying the power provided to the arrays and adjusting the beam profile, dependent on process parameters, by the method described with reference to FIG. 8.

Figure 11:
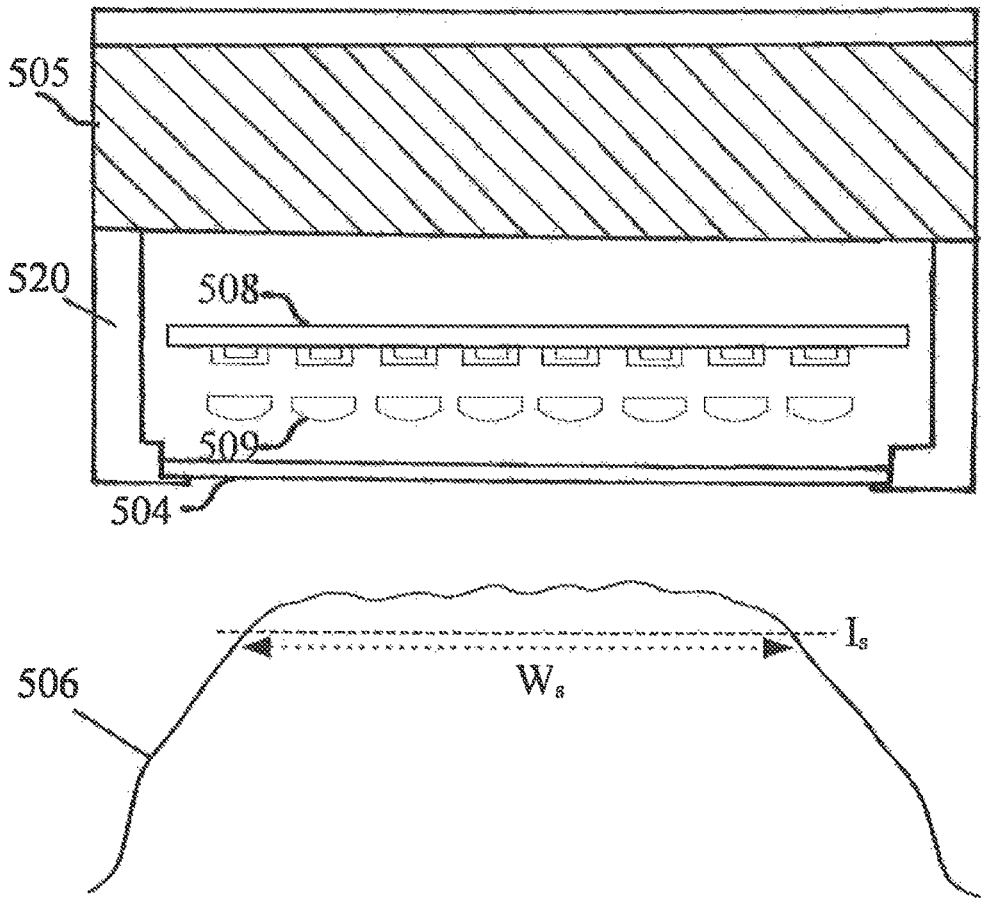
FIG. 11 shows a schematic diagram of a cross section of a lamp head assembly comprising a lamp head with at least one addressable laser diode array wherein the light intensity and light spreading are controllable to produce different beam profiles.

FIG. 11 shows another embodiment of a lamp head assembly of the present invention that has addressable laser diode arrays 508 to produce adjustable optical beam profile required by different process needs. Other elements are similar to that of FIG. 10, except for additional optical elements 509 for adjusting the beam profile, i.e. adjustable rod shaped (cylindrical) lenses 509 coupled to each laser diode array 508. The relative distances between the lenses and the laser diode arrays are adjusted to control the light mixing and therefore change the beam profile. These lenses may be individually adjustable or adjustable in sets.

Figure 12:
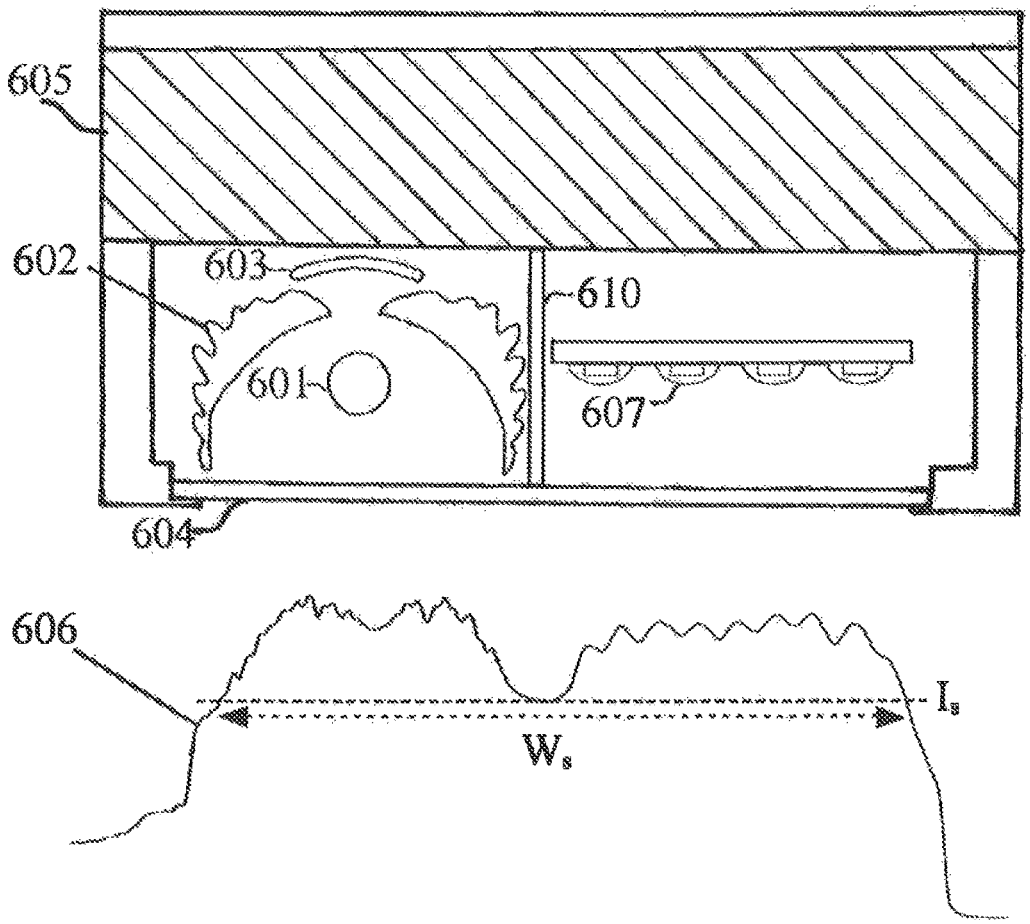
FIG. 12 shows a schematic diagram of a lamp head assembly according to another embodiment of the present invention comprising a combination source with an arc lamp and at least one addressable LED array for producing a beam profile to satisfy process requirements.

FIG. 12 demonstrates one example of an embodiment of the present invention with a combination light source. In this example an arc lamp 601 and LED array 607 are confined in one lamp head with a thermal splitter 610 in between. The arc lamp portion of the lamp head assembly is similar to that shown in FIG. 9, and the LED array is similar to, but not as wide as that shown in FIG. 10. The thermal splitter 610 allows optimization of the thermal management for different sources separately. It also acts like a light splitter to prevent scattered and reflected UV light from the arc lamp 601 from degrading LED encapsulation materials. Thus, in this embodiment, a combination of mechanical and electronic adjustments may be used to control the beam profile and step through a test sequence, as shown in FIG. 8 to determine an optimum beam width $W_s$ and beam profile for a particular process.

It will also be appreciated that other combinations and arrangements of multiple light sources similar to those illustrated in FIGS. 9 to 12 may be combined within the lamp head assembly, to the extent that there is space in the lamp head to accommodate these arrangements, to provide alternative adjustable beam profiles.

It will also be appreciated that other combinations and arrangements of multiple light lamp head assemblies similar to those illustrated in FIGS. 9 to 12, each providing an adjustable beam profile, may be used in combination. Alternatively, one or more adjustable lamp head assemblies, as described, providing for an adjustable beam profile, may be arranged with other lamp head assemblies providing a fixed beam profile. The spatial arrangement of these multiple lamp head assemblies may be arranged to provide a particular temporal and spatial pattern of UV irradiation, to accomplish effective UV curing.

Figure 15:
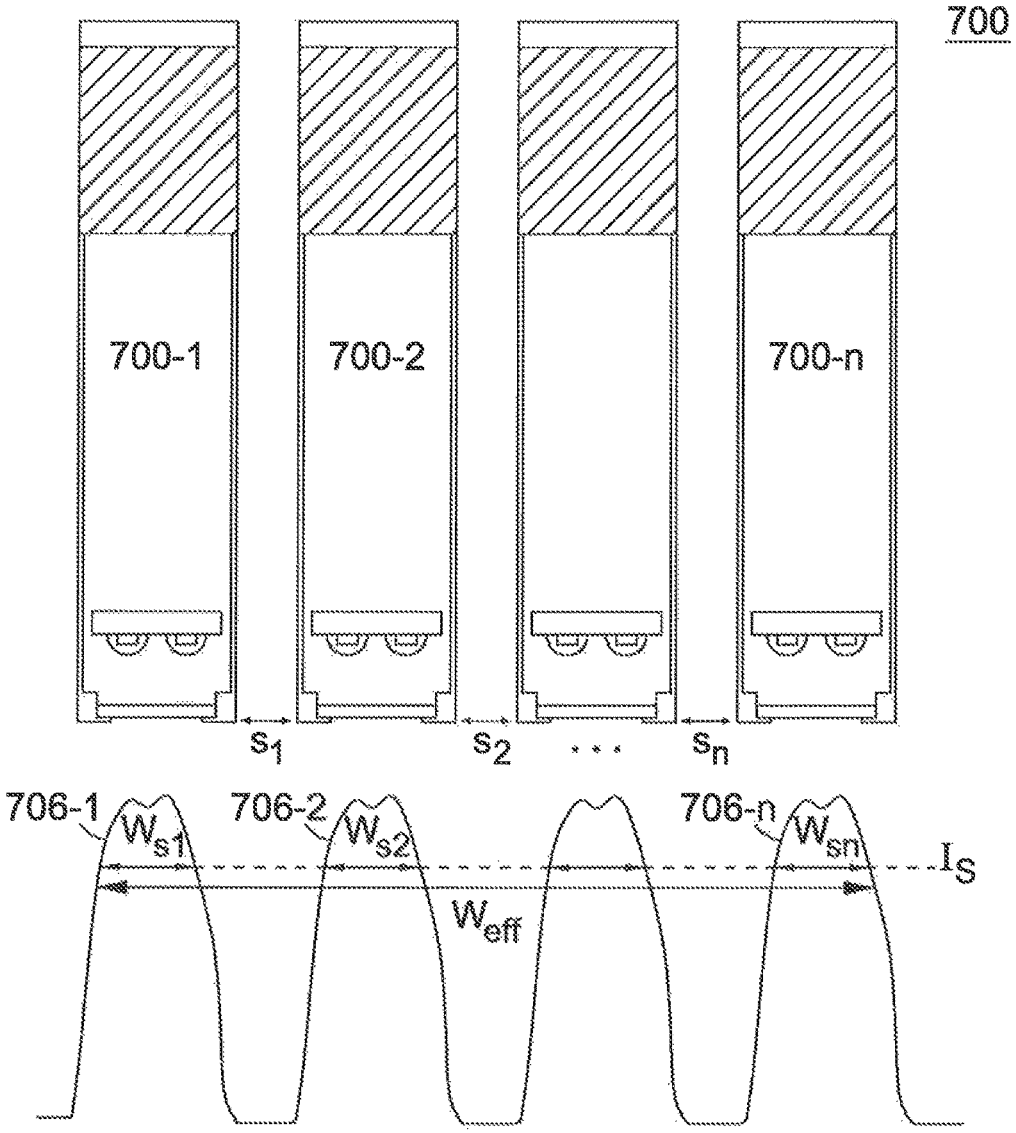
FIG. 15 shows schematically a UV curing system comprising a lamp head comprising a plurality of lamp head sub-assemblies according to an alternative embodiment of the invention.

In a particular example, as shown in FIG. 15, a lamp head assembly 700 that comprises a plurality, i.e. n sub-assemblies, 700-1, 700-2, . . . , **700-*n*, arranged in a linear array (1×n), with spacing $s_1, s_2, s_3, \ldots s_n$ between respective pairs of lamp head sub-assemblies. Each one of these lamp head sub-assemblies can be fixed beam profile lamp head, or adjustable head similar to those illustrated in FIGS. 9 to 12. For simplicity, in FIG. 15, each lamp head sub-assembly is shown as a diode array. The lamp head assembly 700 allows individual adjustment of the distances, $s_1, s_2, \ldots, s_n$, between each pair of the adjacent lamp head sub-assemblies separately (i.e. more generally spacing $s_{mn}$ between lamp m and n in an m×n array of lamps). By adjusting individual lamp head sub-assemblies, 700-1, 700-2, . . . , 700-*n*, the optical beam profile of whole lamp head assembly 700 may be adjusted. The resulting optical beam profile is represented by a combination of individual optical beam profiles, 706-1, 706-2, . . . , 706-*n*. The effective profile width $W_{eff}$, which can be used to define the default lamp profile as input to the method described by FIG. 8, is a sum of the individual lamp head sub-assembly beam profile widths, $W_{s1}, W_{s2}, \ldots W_{sn}$, at or above the saturation level $I_s$, and the respective gaps between adjacent lamp sub-assembly beam profiles at the saturation level $I_s$. The spacing $s_1 \ldots s_n$, between light sources, give rise to portions of the beam profile lower intensity. When these regions are below threshold intensity $I_0$, dark curing may contribute to the curing process during this part of the exposure process. Thus, as shown in FIG. 15**, regions of the beam profile having an intensity above $W_s$ typically result in photo-polymerization or photo-curing, and regions of the effective beam profile width where the intensity is lower, or below threshold $I_0$, may benefit, e.g. from dark curing.

For simplicity, in FIG. 15, the saturation level for each beam profile contributing to the total effective beam width is indicated as a constant $I_s$, with corresponding beam width. It has been assumed, as in the other embodiments described above, that, to a first approximation, that the saturation intensity $I_s$ is a constant. However, it is also to be understood that, in practice, the saturation intensity $I_s$ for a particular material being cured may change during curing, e.g. as polymerization proceeds and the composition of the irradiated material changes. Thus, the actual instantaneous saturation level $I_s$ for a defined UV curable material usually varies with the instantaneous degree of cure. Thus, while FIG. 15 shows several successive beam profiles of similar intensity $I_s$, in practice, the saturation level for each successive beam profile may change, dependent on the specific type of coating or ink, the substrate and other specific process parameters. Nevertheless, a similar process to that described with reference to FIG. 8 may be used to determine an optimum combination of beam profile widths $W_{s1}$, $W_{s2}, \ldots W_{sn}$, and lamp spacings $s_1 \ldots s_n$ to provide the appropriate beam profile for a particular temporal or spatial irradiation pattern for photo-curing at one or more intensities, and/or dark curing, to optimize curing of a particular substrate and ink, dependent on other process parameters. That is, curing may be initiated with an initial or default optical beam profile of a particular effective width $W_{eff}$ comprising provided by n lamps 700-1, 700-2, . . . **700-*n***, with respective widths $W_{s1}$, $W_{s2}$, . . . $W_{sn}$, and spacings $s_1$, $s_2$, . . . $s_n$, and intensities $I_1$, $I_2$, . . . $I_n$, followed by a test cure and assessment of cure results. Then one or more lamp parameters such as beam profile width and intensity of individual lamps, or spacing between lamps, may be adjusted, to determine lamp parameters for optimum curing results.

Although embodiments of the invention have been described and illustrated in detail, it is to be clearly understood that the same is by way of illustration and example only and not to be taken by way of limitation, the scope of the present invention being limited only by the appended claims.

INDUSTRIAL APPLICABILITY

By providing an adjustable UV beam profile, embodiments of systems, methods and lamp head assemblies according to embodiments of the present invention provide for improved control of UV curing for ultra high speed industrial applications, such inkjet printing, with improved print quality and efficiency. The lamp head assembly provides for the beam profile to be adapted to processing conditions and requirements for consistent curing efficiency and print quality at different print speeds. Specific features of such a lamp head assembly may permit adjustment of the spectral, spatial and temporal distribution of light to adapt to UV irradiation to a particular ink/coating and substrate, print speed, or other process conditions, for improved or optimized curing efficiency in ultra-fast UV curing applications.

The invention claimed is:

1. A system for UV curing of photosensitive materials comprising:

means for supporting a substrate comprising photosensitive materials to be cured;

a lamp head comprising a lamp assembly comprising:

at least one (UV) light source and optical elements for generating a UV beam of a desired beam profile for irradiating an area of the photosensitive materials to be cured;

means for relatively moving the substrate and the lamp head at a desired traverse speed (v) for sequentially illuminating areas of the substrate; and control means, the control means including:

beam profile adjustment means for controlling lamp parameters of the lamp assembly to adjust the beam profile by controlling at least a beam width ($W_s$) and beam intensity profile I(w), dependent on the traverse speed (v) and other process parameters, wherein the control means further comprises input means for inputting said process parameters, and control/adjustment means on the lamp head assembly for setting lamp parameters based on said process parameters, and wherein the beam profile control means comprises means for controlling parameters of the lamp assembly to pro vide a beam profile having a desired spectral, spatial and temporal distribution of light dependent on said process parameters.

2. A system according to claim 1, wherein the control means further comprises input means for inputting print test results, and control/adjustment means on the lamp head assembly for setting lamp parameters based on said print test results.

3. A system according to claim 1, wherein said process parameters comprise one or more of substrate and ink parameters; print speed; environmental parameters; and print quality requirements.

4. A system according to claim 1, comprising a plurality of (UV) light sources and a plurality of optical elements, wherein intensities of each of the plurality of (UV) light sources are independently controllable, and the positions of the (UV) light sources and optical elements are adjustable relative to each other to control the beam width ($W_s$) and beam intensity profile I(w) in a scan direction, dependent on the traverse speed (v).

5. A system according to claim 1, comprising two (UV) light sources arranged between two side reflectors, and a top reflector between the two side reflectors, wherein the two (UV) light sources, the two side reflectors and the top reflector are movable relative to each other to control the beam width ($W_s$) and beam intensity profile I(w) in a scan direction, dependent on the traverse speed (v).

6. A system according to claim 1, comprising one (UV) light source, a pair of side reflectors and a top reflector, which are movable relative to each other to control the beam width ($W_s$) and beam intensity profile I(w) in a scan direction, dependent on the traverse speed (v).

7. A system according to claim 1, wherein the (UV) light source comprises one or more of UV radiation sources selected from arc lamps, microwave lamps, UV LED arrays, laser diode arrays and combinations thereof.

8. A system for UV curing of photosensitive materials comprising:

means for supporting a substrate comprising photosensitive materials to be cured;

a lamp head comprising a lamp assembly comprising:

at least one (UV) light source and optical elements for generating a UV beam of a desired beam profile for irradiating an area of the photosensitive materials to be cured;

means for relatively moving the substrate and the lamp head at a desired traverse speed (v) for sequentially illuminating areas of the substrate; and control means, the control means including:

beam profile adjustment means for controlling lamp parameters of the lamp assembly to adjust the beam profile by controlling at least a beam width ($W_s$) and beam intensity profile I(w), dependent on the traverse speed (v) and other process parameters, wherein the beam profile adjustment means is further configured for controlling the beam width ($W_s$) in a scan direction dependent on an induction time of the UV curing process.

9. A system according to claim 8, wherein the beam profile adjustment means is further configured for adjustment of the beam intensity profile I(w) across the beam width ($W_s$), based on input of at least one of an empirically determined threshold intensity level $I_0$ and an empirically determined saturation intensity level $I_s$.

10. A system for UV curing of photosensitive materials comprising:

means for supporting a substrate comprising photosensitive materials to be cured;

a lamp head comprising a lamp assembly comprising:

at least one (UV) light source and optical elements for generating a UV beam of a desired beam profile for irradiating an area of the photosensitive materials to be cured;

means for relatively moving the substrate and the lamp head at a desired traverse speed (v) for sequentially illuminating areas of the substrate; and control means, the control means including:

beam profile adjustment means for controlling lamp parameters of the lamp assembly to adjust the beam profile by controlling at least a beam width ($W_s$) and beam intensity profile I(w), dependent on the traverse speed (v) and other process parameters;

a plurality of (UV) light sources and a plurality of optical elements, wherein intensities of each of the plurality of (UV) light sources are independently controllable, and the positions of the (UV) light sources and optical elements are adjustable relative to each other to control beam width ($W_s$) and beam intensity profile I(w) in a scan direction, dependent on the traverse speed (v), wherein the plurality of (UV) light sources comprise identical LED arrays and wherein a distance between LED arrays and/or the reflectors are adjustable for controlling the beam width ($W_s$) and peak intensity of the beam intensity profile I(w).

11. A system for UV curing of photosensitive materials comprising:

means for supporting a substrate comprising photosensitive materials to be cured;

a lamp head comprising a lamp assembly comprising:

at least one (UV) light source and optical elements for generating a UV beam of a desired beam profile for irradiating an area of the photosensitive materials to be cured;

means for relatively moving the substrate and the lamp head at a desired traverse speed (v) for sequentially illuminating areas of the substrate; and control means, the control means including:

beam profile adjustment means for controlling lamp parameters of the lamp assembly to adjust the beam profile by controlling al least a beam width ($W_s$) and beam intensity profile I(w), dependent on the traverse speed (v) and other process parameters;

a plurality of (UV) light sources and a plurality of optical elements, wherein intensities of each of the plurality of (UV) light sources are independently controllable, and the positions of the (UV) light sources and optical elements are adjustable relative to each other to control beam width ($W_s$) and beam intensity profile I(w) in a scan direction, dependent on the traverse speed (v), wherein the plurality of (UV) light sources comprise two or more LED arrays having a different spectral output and intensities.

12. A system for UV curing of photosensitive materials comprising:

means for supporting a substrate comprising photosensitive materials to be cured;

a lamp head comprising a lamp assembly comprising:

at least one (UV) light source and optical elements for generating a UV beam of a desired beam profile for irradiating an area of the photosensitive materials to be cured;

means for relatively moving the substrate and the lamp head at a desired traverse speed (v) for sequentially illuminating areas of the substrate; and control means, the control means including:

beam profile adjustment means for controlling lamp parameters of the lamp assembly to adjust the beam profile by controlling at least a beam width ($W_s$) and beam intensity profile I(w), dependent on the traverse speed (v) and other process parameters;

a plurality of (UV) light sources and a plurality of optical elements, wherein intensities of each of the plurality of (UV) light sources are independently controllable, and the positions of the (UV) light sources and optical elements are adjustable relative to each other to control beam width ($W_s$) and beam intensity profile I(w) in a scan direction, dependent on the traverse speed (v), wherein the plurality of (UV) light sources comprise two or more LED arrays having different maximum power, a lower power LED array for providing wide lower intensity portion of the beam profile for overcoming oxygen inhibition, and a higher power LED array providing a narrow intense portion of the beam profile for surface curing.

13. A system according to claim 12, wherein the higher power LED array has a different spectral output from the lower power LED array.

14. A system according to claim 12, wherein the lower power LED array provides a D-lamp spectrum and the higher power LED array comprises a H-lamp spectrum for surface curing.

15. A system for UV curing of photosensitive materials comprising:

means for supporting a substrate comprising photosensitive materials to be cured;

a lamp head comprising a lamp assembly comprising:

at least one (UV) light source and optical elements for generating a UV beam of a desired beam profile for irradiating an area of the photosensitive materials to be cured;

means for relatively moving the substrate and the lamp head at a desired traverse speed (v) for sequentially illuminating areas of the substrate; and control means, the control means including:

beam profile adjustment means for controlling lamp parameters of the lamp assembly to adjust the beam profile by controlling at least a beam width ($W_s$) and beam intensity profile I(w), dependent on the traverse speed (v) and other process parameters;

a plurality of (UV) light sources and a plurality of optical elements, wherein intensities of each of the plurality of (UV) light sources are independently controllable, and the positions of the (UV) light sources and optical elements are adjustable relative to each other to control beam width ($W_s$) and beam intensity profile I(w) in a scan direction, dependent on the traverse speed (v), wherein the plurality of (UV) light sources comprise a first LED array having a first wavelength emission and a second LED array having a second wavelength emission lower than the first wavelength emission.

16. A system according to claim 15 wherein the first LED array has a higher emission intensity than the second LED array.

* * * * *